US008852399B2

(12) United States Patent
Neal et al.

(10) Patent No.: US 8,852,399 B2
(45) Date of Patent: Oct. 7, 2014

(54) POLYMER-CONTAINING ARTICLES OF MANUFACTURE AND METHODS FOR MAKING SAME

(75) Inventors: Charles William Neal, Fairfield, OH (US); Charles Allen Redd, Harrison, OH (US); Jeffrey Glen Sheehan, Cincinnati, OH (US); Steven Daryl Smith, Fairfield, OH (US); Robert Joseph McChain, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 70 days.

(21) Appl. No.: 13/223,454

(22) Filed: Sep. 1, 2011

(65) Prior Publication Data

US 2012/0055643 A1 Mar. 8, 2012

Related U.S. Application Data

(60) Provisional application No. 61/379,792, filed on Sep. 3, 2010.

(51) Int. Cl.

| | |
|---|---|
| ***D21H 17/33*** | (2006.01) |
| ***D21H 17/45*** | (2006.01) |
| ***D21H 21/00*** | (2006.01) |
| ***D21H 27/00*** | (2006.01) |
| ***C11D 17/04*** | (2006.01) |
| *D21H 21/24* | (2006.01) |
| *D21H 21/22* | (2006.01) |
| *D21H 17/37* | (2006.01) |

(52) U.S. Cl.

CPC ..... *D21H 27/002* (2013.01); *D21H 17/45* (2013.01); *D21H 27/004* (2013.01); *D21H 17/455* (2013.01); *C11D 17/041* (2013.01); *D21H 21/24* (2013.01); *D21H 21/22* (2013.01); *D21H 17/375* (2013.01)

USPC ..... 162/168.3; 162/168.1; 162/168.2; 162/158; 162/231

(58) Field of Classification Search

USPC ..... 162/158, 164.1, 164.6, 166, 162/168.1–168.3, 231, 183–185; 428/500, 428/507, 511

See application file for complete search history.

(56) References Cited

U.S. PATENT DOCUMENTS

| | | | | |
|---|---|---|---|---|
| 4,624,890 | A * | 11/1986 | Lloyd et al. | 442/93 |
| 5,914,177 | A * | 6/1999 | Smith et al. | 428/195.1 |
| 6,716,805 | B1 * | 4/2004 | Sherry et al. | 510/295 |
| 7,803,250 | B2 | 9/2010 | Dyer et al. | |
| 2003/0216272 | A1 * | 11/2003 | Sherry et al. | 510/295 |
| 2004/0082668 | A1 * | 4/2004 | Vinson | 516/38 |
| 2005/0130870 | A1 | 6/2005 | Ochomogo et al. | |
| 2005/0192199 | A1 * | 9/2005 | Cartwright et al. | 510/420 |
| 2006/0052269 | A1 | 3/2006 | Panandiker et al. | |
| 2006/0234901 | A1 | 10/2006 | Scheuing et al. | |
| 2008/0293613 | A1 * | 11/2008 | Johnson et al. | 510/438 |

FOREIGN PATENT DOCUMENTS

| | | | |
|---|---|---|---|
| EP | 0 153 146 | A1 | 8/1985 |
| WO | WO 00/32727 | A1 | 6/2000 |
| WO | WO 01/23510 | A2 | 4/2001 |
| WO | WO 2004/067693 | A2 | 8/2004 |

OTHER PUBLICATIONS

International Search Report mailed Nov. 30, 2011.

* cited by examiner

*Primary Examiner* — Dennis Cordray
(74) *Attorney, Agent, or Firm* — C. Brant Cook

(57) ABSTRACT

Polymer-containing articles of manufacture that provide one or more superior properties, such as soil adsorption properties, mirror cleaning properties, and/or absorption properties, compared to known polymer-containing articles of manufacture, are provided.

44 Claims, 7 Drawing Sheets

| | | | |
|---|---|---|---|
| Side 3 - Wet Side to Side | Side 1 - Wet Side to Side | Side 5 - Wet Side to Side | Side 7 - Wet Side to Side |
| Side 4 - Dry Up and Down | Side 2 - Dry Up and Down | Side 6 - Dry Up and Down | Side 8 - Dry Up and Down |

FIG. 4

| | | |
|---|---|---|
| 1 | 2 | 3 |
| 4 | 5 | 6 |
| 7 | 8 | 9 |

FIG. 5

POLYMER-CONTAINING ARTICLES OF MANUFACTURE AND METHODS FOR MAKING SAME

CROSS REFERENCE TO RELATED APPLICATIONS

This application claims the benefit of U.S. Provisional Application No. 61/379,792, filed Sep. 3, 2010.

FIELD OF THE INVENTION

The present invention relates to polymer-containing articles of manufacture that provide one or more superior properties, such as soil adsorption properties, mirror cleaning properties, and/or absorption properties, compared to known polymer-containing articles of manufacture. More particularly, the present invention relates to soil adsorbing articles of manufacture, such as soil adsorbing fibrous structures that provide superior soil adsorption properties compared to known soil adsorbing articles of manufacture and methods for making same.

BACKGROUND OF THE INVENTION

In the past, fibrous structures, such as paper towels, have been commonly utilized in combination with liquid cleaning compositions to clean windows, mirrors, countertops, and other hard surfaces. Known paper towels typically provide cleaning performance primarily by absorption of soil laden fluid into the pores of the paper towel, consequently, the cleaning performance of known paper towels is limited by the ability of the paper towels to absorb and retain the soil laden fluid.

Improved removal of soil from various surfaces continues to be a big consumer need. Formulators have attempted to enhance the soil removal properties of known paper towels by incorporating polymeric soil adsorbing agents into liquid cleaning compositions used in conjunction with paper towels. There are known liquid cleaning compositions, such as liquid spray cleaners, that comprise a polymeric soil adsorbing agent, for example a copolymer of an acrylic acid and a diquaternary ammonium compound, such as a Mirapol® polymer is commercially available from Rhodia and/or a polyethyleneimine polymer, such as a Lupasol® polymer is commercially available from BASF Corporation. Such liquid cleaning compositions are designed to aid in the removal of soil from various soil laden surfaces, including mirrors, when the liquid cleaning compositions are applied to such surfaces in a liquid form resulting in a soil laden fluid that is capable of being absorbed by a paper towel. In addition, it is known that such liquid cleaning compositions may be applied directly to an article of manufacture, such as a paper towel, by a user immediately before contacting a soil laden surface with the liquid cleaning composition-treated paper towel. Further, it is known that such liquid cleaning compositions may be applied to an article of manufacture, such as a wipe during the wipe's manufacturing process to produce a wet wipe. Further yet, it is known that a dry substrate comprising an impregnated soil adsorbing agent may be moistened and/or dipped into a liquid, such as a liquid cleaning composition, prior to use in order to apparently activate the soil adsorbing agent.

As can be seen from above, formulators in the past apparently believed that soil adsorbing agents, particularly soil adsorbing agent polymers, needed to be present in a liquid, such as in a liquid cleaning composition alone or as part of an article of manufacture, such as a wipe or other substrate, in order to be effective in adsorbing soil.

However, consumers desire dry articles of manufacture (less than 30% and/or less than 20% and/or less than 15% and/or less than 10% and/or less than 5% moisture by weight of the article of manufacture) that exhibit superior soil adsorbing properties compared to known articles of manufacture.

It is believed that adsorption of soil by an article of manufacture, such as a dry fibrous structure, is a better mechanism for soil removal and/or retention than absorption of a soil laden liquid.

One attempt at an article of manufacture that exhibits better soil adsorption properties compared to known articles of manufacture, such as known paper towels, includes a dry wipe that has been impregnated with a polycationic polymer, for example a polyethyleneimine, such as Lupasol®, which is available from BASF, which exhibits a charge density at pH of 4.5 of greater than 10 meq/g; namely +17.8 meq/g. The soil adsorption properties and/or mirror cleaning properties of the dry wipe containing Lupasol® fall well short of consumers' needs and desires.

In addition, almost 25 years ago another attempt at an article of manufacture that exhibits better soil adsorption properties compared to known articles of manufacture at the time includes an article of manufacture that has been impregnated with a cationic polyacrylamide soil adsorbing agent. Such an article of manufacture was taught as requiring a liquid composition, such as a liquid cleaning composition to be added to and/or present on the article of manufacture before using the article of manufacture to clean soil laden surfaces.

In addition to the above uses, suppliers of polyacrylamides such as HyChem, Inc. have provided polyacrylamide polymers to paper manufacturers as retention aids for cellulose fines and/or filler particles and as drainage aids for use in the wet-end of a papermaking machine. For this application, the supplier instructs the manufacturer to prepare dilute aqueous solutions (less than about 0.2% active) where the polymer solutions are permitted to age resulting in the uncoiling of the high molecular weight polyacrylamide chains present in the solutions. Addition rates recommended by the suppliers are less than about 0.5 lb/ton active to avoid overflocculation of the paper sheet causing poor formation. However, such wet-end uses of polyacrylamides do not significantly improve the soil adsorption of the resulting paper made by such processes. In addition, suppliers like HyChem, Inc. typically supply such polyacrylamides in water or water-in-oil inverse emulsions that are made up by adding the neat polymer into a vortex of a stirred tank of water to prepare a solution of 1% concentration (as is). Aging for 30-60 minutes is recommended, followed by in-line dilution to 0.1% or less to invert the emulsions, as is recommended by the suppliers.

In light of the foregoing, it is clear that there has existed a long felt, unmet need for an article of manufacture, such as a fibrous structure, more particularly a dry fibrous structure, that exhibits superior soil adsorption properties and/or mirror cleaning properties and/or absorption properties compared to known articles of manufacture.

SUMMARY OF THE INVENTION

The present invention fulfills the needs described above by providing an article of manufacture, such as a fibrous structure, for example a dry paper towel that exhibits superior soil adsorption properties, including cleaning of various hard surfaces including mirrors, and/or absorption properties compared to known articles of manufacture.

In one example of the present invention, an article of manufacture that exhibits an average Soil Adsorption Value of about 90 mg soil/g article of manufacture or greater as measured according to the Soil Adsorption Test Method described herein, is provided.

In another example of the present invention, an article of manufacture comprising a polymer, such as a soil adsorbing agent (also referred to as a soil retention agent), wherein the article of manufacture exhibits an average Soil Adsorption Value of about 90 mg soil/g article of manufacture or greater as measured according to the Soil Adsorption Test Method described herein, is provided.

In yet another example of the present invention, a dry article of manufacture that exhibits an average Soil Adsorption Value of about 90 mg soil/g article of manufacture or greater as measured according to the Soil Adsorption Test Method described herein, is provided.

In even yet another example of the present invention, a dry article of manufacture comprising a soil adsorbing agent, wherein the article of manufacture exhibits an average Soil Adsorption Value of about 90 mg soil/g article of manufacture or greater as measured according to the Soil Adsorption Test Method described herein, is provided In still another example of the present invention, a method for making an article of manufacture that exhibits an average Soil Adsorption Value of about 90 mg soil/g article of manufacture or greater as measured according to the Soil Adsorption Test Method described herein, the method comprising the step of contacting an article of manufacture with a soil adsorbing agent such that the article of manufacture exhibits an average Soil Adsorption Value of about 90 mg soil/g article of manufacture or greater as measured according to the Soil Adsorption Test Method described herein, is provided.

In even still another example of the present invention, a method for making an article of manufacture that exhibits an average Soil Adsorption Value of about 90 mg soil/g article of manufacture or greater as measured according to the Soil Adsorption Test Method described herein, the method comprising the step of forming the article of manufacture from a composition comprising a soil adsorbing agent such that the article of manufacture exhibits an average Soil Adsorption Value of about 90 mg soil/g article of manufacture or greater as measured according to the Soil Adsorption Test Method described herein, is provided.

In another example of the present invention, a method for making a dry article of manufacture that exhibits an average Soil Adsorption Value of about 90 mg soil/g article of manufacture or greater as measured according to the Soil Adsorption Test Method described herein, the method comprising the step of contacting a dry article of manufacture with a soil adsorbing agent such that the dry article of manufacture exhibits an average Soil Adsorption Value of about 90 mg soil/g article of manufacture or greater as measured according to the Soil Adsorption Test Method described herein, is provided.

In yet another example of the present invention, a method for making a dry article of manufacture that exhibits an average Soil Adsorption Value of about 90 mg soil/g article of manufacture or greater as measured according to the Soil Adsorption Test Method described herein, the method comprising the step of forming the dry article of manufacture from a composition comprising a soil adsorbing agent such that the dry article of manufacture exhibits an average Soil Adsorption Value of about 90 mg soil/g article of manufacture or greater as measured according to the Soil Adsorption Test Method described herein, is provided.

In even yet another example of the present invention, an article of manufacture that exhibits an average Mirror Cleaning Visual Grade Value of less than 2.5 as measured according to the Mirror Cleaning Test Method described herein, is provided.

In another example of the present invention, an article of manufacture comprising a soil adsorbing agent, wherein the article of manufacture exhibits an average Mirror Cleaning Visual Grade Value of less than 2.5 as measured according to the Mirror Cleaning Test Method described herein, is provided In yet another example of the present invention, a dry article of manufacture that exhibits an average Mirror Cleaning Visual Grade Value of less than 2.5 as measured according to the Mirror Cleaning Test Method described herein, is provided.

In even yet another example of the present invention, a dry article of manufacture comprising a soil adsorbing agent, wherein the article of manufacture exhibits an average Mirror Cleaning Visual Grade Value of less than 2.5 as measured according to the Mirror Cleaning Test Method described herein, is provided In still another example of the present invention, a method for making an article of manufacture that exhibits an average Mirror Cleaning Visual Grade Value of less than 2.5 as measured according to the Mirror Cleaning Test Method described herein, the method comprising the step of contacting an article of manufacture with a soil adsorbing agent such that the article of manufacture exhibits an average Mirror Cleaning Visual Grade Value of less than 2.5 as measured according to the Mirror Cleaning Test Method described herein, is provided.

In even still another example of the present invention, a method for making an article of manufacture that exhibits an average Mirror Cleaning Visual Grade Value of less than 2.5 as measured according to the Mirror Cleaning Test Method described herein, the method comprising the step of forming the article of manufacture from a composition comprising a soil adsorbing agent such that the article of manufacture exhibits an average Mirror Cleaning Visual Grade Value of less than 2.5 as measured according to the Mirror Cleaning Test Method described herein, is provided.

In another example of the present invention, a method for making a dry article of manufacture that exhibits an average Mirror Cleaning Visual Grade Value of less than 2.5 as measured according to the Mirror Cleaning Test Method described herein, the method comprising the step of contacting a dry article of manufacture with a soil adsorbing agent such that the dry article of manufacture exhibits an average Mirror Cleaning Visual Grade Value of less than 2.5 as measured according to the Mirror Cleaning Test Method described herein, is provided.

In yet another example of the present invention, a method for making a dry article of manufacture that exhibits an average Mirror Cleaning Visual Grade Value of less than 2.5 as measured according to the Mirror Cleaning Test Method described herein, the method comprising the step of forming the dry article of manufacture from a composition comprising a soil adsorbing agent such that the dry article of manufacture exhibits an average Mirror Cleaning Visual Grade Value of less than 2.5 as measured according to the Mirror Cleaning Test Method described herein, is provided.

In even still yet another example of the present invention, an article of manufacture that exhibits a total Mirror Cleaning Visual Grade Value of less than 10 as measured according to the Mirror Cleaning Test Method described herein, is provided.

In another example of the present invention, an article of manufacture comprising a soil adsorbing agent, wherein the article of manufacture exhibits a total Mirror Cleaning Visual Grade Value of less than 10 as measured according to the Mirror Cleaning Test Method described herein, is provided In yet another example of the present invention, a dry article of manufacture that exhibits a total Mirror Cleaning Visual Grade Value of less than 10 as measured according to the Mirror Cleaning Test Method described herein, is provided.

In even yet another example of the present invention, a dry article of manufacture comprising a soil adsorbing agent, wherein the article of manufacture exhibits a total Mirror Cleaning Visual Grade Value of less than 10 as measured according to the Mirror Cleaning Test Method described herein, is provided In still another example of the present invention, a method for making an article of manufacture that exhibits a total Mirror Cleaning Visual Grade Value of less than 10 as measured according to the Mirror Cleaning Test Method described herein, the method comprising the step of contacting an article of manufacture with a soil adsorbing agent such that the article of manufacture exhibits a total Mirror Cleaning Visual Grade Value of less than 10 as measured according to the Mirror Cleaning Test Method described herein, is provided.

In even still another example of the present invention, a method for making an article of manufacture that exhibits a total Mirror Cleaning Visual Grade Value of less than 10 as measured according to the Mirror Cleaning Test Method described herein, the method comprising the step of forming the article of manufacture from a composition comprising a soil adsorbing agent such that the article of manufacture exhibits a total Mirror Cleaning Visual Grade Value of less than 10 as measured according to the Mirror Cleaning Test Method described herein, is provided.

In another example of the present invention, a method for making a dry article of manufacture that exhibits a total Mirror Cleaning Visual Grade Value of less than 10 as measured according to the Mirror Cleaning Test Method described herein, the method comprising the step of contacting a dry article of manufacture with a soil adsorbing agent such that the dry article of manufacture exhibits a total Mirror Cleaning Visual Grade Value of less than 10 as measured according to the Mirror Cleaning Test Method described herein, is provided.

In yet another example of the present invention, a method for making a dry article of manufacture that exhibits a total Mirror Cleaning Visual Grade Value of less than 10 as measured according to the Mirror Cleaning Test Method described herein, the method comprising the step of forming the dry article of manufacture from a composition comprising a soil adsorbing agent such that the dry article of manufacture exhibits a total Mirror Cleaning Visual Grade Value of less than 10 as measured according to the Mirror Cleaning Test Method described herein, is provided.

In even yet another example of the present invention, an article of manufacture that exhibits an average Mirror Cleaning Densitometer Value of −0.46 or greater as measured according to the Mirror Cleaning Test Method described herein, is provided.

In another example of the present invention, an article of manufacture comprising a soil adsorbing agent, wherein the article of manufacture exhibits an average Mirror Cleaning Densitometer Value of −0.46 or greater as measured according to the Mirror Cleaning Test Method described herein, is provided In yet another example of the present invention, a dry article of manufacture that exhibits an average Mirror Cleaning Densitometer Value of −0.46 or greater as measured according to the Mirror Cleaning Test Method described herein, is provided.

In even yet another example of the present invention, a dry article of manufacture comprising a soil adsorbing agent, wherein the article of manufacture exhibits an average Mirror Cleaning Densitometer Value of −0.46 or greater as measured according to the Mirror Cleaning Test Method described herein, is provided In still another example of the present invention, a method for making an article of manufacture that exhibits an average Mirror Cleaning Densitometer Value of −0.46 or greater as measured according to the Mirror Cleaning Test Method described herein, the method comprising the step of contacting an article of manufacture with a soil adsorbing agent such that the article of manufacture exhibits an average Mirror Cleaning Densitometer Value of −0.46 or greater as measured according to the Mirror Cleaning Test Method described herein, is provided.

In even still another example of the present invention, a method for making an article of manufacture that exhibits an average Mirror Cleaning Densitometer Value of −0.46 or greater as measured according to the Mirror Cleaning Test Method described herein, the method comprising the step of forming the article of manufacture from a composition comprising a soil adsorbing agent such that the article of manufacture exhibits an average Mirror Cleaning Densitometer Value of −0.46 or greater as measured according to the Mirror Cleaning Test Method described herein, is provided.

In another example of the present invention, a method for making a dry article of manufacture that exhibits an average Mirror Cleaning Densitometer Value of −0.46 or greater as measured according to the Mirror Cleaning Test Method described herein, the method comprising the step of contacting a dry article of manufacture with a soil adsorbing agent such that the dry article of manufacture exhibits an average Mirror Cleaning Densitometer Value of −0.46 or greater as measured according to the Mirror Cleaning Test Method described herein, is provided.

In yet another example of the present invention, a method for making a dry article of manufacture that exhibits an average Mirror Cleaning Densitometer Value of −0.46 or greater as measured according to the Mirror Cleaning Test Method described herein, the method comprising the step of forming the dry article of manufacture from a composition comprising a soil adsorbing agent such that the dry article of manufacture exhibits an average Mirror Cleaning Densitometer Value of −0.46 or greater as measured according to the Mirror Cleaning Test Method described herein, is provided.

In even still yet another example of the present invention, an article of manufacture that exhibits a total Mirror Cleaning Densitometer Value of −1.82 or greater as measured according to the Mirror Cleaning Test Method described herein, is provided.

In another example of the present invention, an article of manufacture comprising a soil adsorbing agent, wherein the article of manufacture exhibits a total Mirror Cleaning Densitometer Value of −1.82 or greater as measured according to the Mirror Cleaning Test Method described herein, is provided In yet another example of the present invention, a dry article of manufacture that exhibits a total Mirror Cleaning Densitometer Value of −1.82 or greater as measured according to the Mirror Cleaning Test Method described herein, is provided.

In even yet another example of the present invention, a dry article of manufacture comprising a soil adsorbing agent, wherein the article of manufacture exhibits a total Mirror Cleaning Densitometer Value of −1.82 or greater as measured according to the Mirror Cleaning Test Method described herein, is provided In still another example of the present invention, a method for making an article of manufacture that exhibits a total Mirror Cleaning Densitometer Value of −1.82 or greater as measured according to the Mirror Cleaning Test Method described herein, the method comprising the step of contacting an article of manufacture with a soil adsorbing agent such that the article of manufacture exhibits a total Mirror Cleaning Densitometer Value of −1.82 or greater as measured according to the Mirror Cleaning Test Method described herein, is provided.

In even still another example of the present invention, a method for making an article of manufacture that exhibits a total Mirror Cleaning Densitometer Value of −1.82 or greater as measured according to the Mirror Cleaning Test Method described herein, the method comprising the step of forming the article of manufacture from a composition comprising a soil adsorbing agent such that the article of manufacture exhibits a total Mirror Cleaning Densitometer Value of −1.82 or greater as measured according to the Mirror Cleaning Test Method described herein, is provided.

In another example of the present invention, a method for making a dry article of manufacture that exhibits a total Mirror Cleaning Densitometer Value of −1.82 or greater as measured according to the Mirror Cleaning Test Method described herein, the method comprising the step of contacting a dry article of manufacture with a soil adsorbing agent such that the dry article of manufacture exhibits a total Mirror Cleaning Densitometer Value of −1.82 or greater as measured according to the Mirror Cleaning Test Method described herein, is provided.

In yet another example of the present invention, a method for making a dry article of manufacture that exhibits a total Mirror Cleaning Densitometer Value of −1.82 or greater as measured according to the Mirror Cleaning Test Method described herein, the method comprising the step of forming the dry article of manufacture from a composition comprising a soil adsorbing agent such that the dry article of manufacture exhibits a total Mirror Cleaning Densitometer Value of −1.82 or greater as measured according to the Mirror Cleaning Test Method described herein, is provided.

In even still yet another example of the present invention, a method for cleaning a surface, the method comprising the step of:

a. providing an article of manufacture, such as a dry article of manufacture, for example a dry paper towel; and
b. applying a composition comprising a soil adsorbing agent onto the article of manufacture such that the article of manufacture exhibits an average Soil Adsorption Value of about 90 mg soil/g article of manufacture or greater as measured according to the Soil Adsorption Test Method described herein and/or an average Mirror Cleaning Visual Grade Value of less than 2.5 as measured according to the Mirror Cleaning Test Method described herein and/or a total Mirror Cleaning Visual Grade Value of less than 10 as measured according to the Mirror Cleaning Test Method described herein, is provided.

In even still yet another example of the present invention, a method for cleaning a surface, the method comprising the step of:

a. providing an article of manufacture, such as a dry article of manufacture, for example a dry paper towel; and
b. instructing a user of the article of manufacture to apply a composition comprising a soil adsorbing agent onto the article of manufacture such that the article of manufacture exhibits an average Soil Adsorption Value of about 90 mg soil/g article of manufacture or greater as measured according to the Soil Adsorption Test Method described herein and/or an average Mirror Cleaning Visual Grade Value of less than 2.5 as measured according to the Mirror Cleaning Test Method described herein and/or a total Mirror Cleaning Visual Grade Value of less than 10 as measured according to the Mirror Cleaning Test Method described herein, is provided.

In even still yet another example of the present invention, an article of manufacture comprising an article of manufacture, such as a dry article of manufacture, for example a dry paper towel, and a composition comprising a soil adsorbing agent that when applied to the article of manufacture results in the article of manufacture, for example a dry article of manufacture, exhibiting an average Soil Adsorption Value of about 90 mg soil/g article of manufacture or greater as measured according to the Soil Adsorption Test Method described herein and/or an average Mirror Cleaning Visual Grade Value of less than 2.5 as measured according to the Mirror Cleaning Test Method described herein and/or a total Mirror Cleaning Visual Grade Value of less than 10 as measured according to the Mirror Cleaning Test Method described herein, is provided.

In even still yet another example of the present invention, a method for cleaning a surface, the method comprising the step of:

a. providing an article of manufacture, such as a dry article of manufacture, for example a dry paper towel; and
b. applying a composition comprising a soil adsorbing agent onto the article of manufacture such that the article of manufacture exhibits an average Soil Adsorption Value of about 90 mg soil/g article of manufacture or greater as measured according to the Soil Adsorption Test Method described herein and/or an average Mirror Cleaning Densitometer Value of −0.46 or greater as measured according to the Mirror Cleaning Test Method described herein and/or a total Mirror Cleaning Densitometer Value of −1.82 or greater as measured according to the Mirror Cleaning Test Method described herein, is provided.

In even still yet another example of the present invention, a method for cleaning a surface, the method comprising the step of:

a. providing an article of manufacture, such as a dry article of manufacture, for example a dry paper towel; and
b. instructing a user of the article of manufacture to apply a composition comprising a soil adsorbing agent onto the article of manufacture such that the article of manufacture exhibits an average Soil Adsorption Value of about 90 mg soil/g article of manufacture or greater as measured according to the Soil Adsorption Test Method described herein and/or an average Mirror Cleaning Densitometer Value of −0.46 or greater as measured according to the Mirror Cleaning Test Method described herein and/or a total Mirror Cleaning Densitometer Value of −1.82 or greater as measured according to the Mirror Cleaning Test Method described herein, is provided.

In even still yet another example of the present invention, an article of manufacture comprising an article of manufacture, such as a dry article of manufacture, for example a dry paper towel, and a composition comprising a soil adsorbing agent that when applied to the article of manufacture results in the article of manufacture, for example a dry article of manufacture, exhibiting an average Soil Adsorption Value of about 90 mg soil/g article of manufacture or greater as measured according to the Soil Adsorption Test Method described herein and/or an average Mirror Cleaning Densitometer Value of −0.46 or greater as measured according to the Mirror Cleaning Test Method described herein and/or a total Mirror Cleaning Densitometer Value of −1.82 or greater as measured according to the Mirror Cleaning Test Method described herein, is provided.

In even still another example of the present invention, an article of manufacture, such as a fibrous structure, for example a dry fibrous structure, such as a paper towel, comprising a polymer, such as a soil adsorbing polymer, for example a cationic soil adsorbing polymer, wherein the article of manufacture exhibits a VFS Absorbent Capacity of greater than 11 g/g as measured according to the VFS Test Method described herein.

The article of manufacture and the composition comprising the soil adsorbing agent may be co-packaged together and/or sold to consumers together.

Accordingly, the present invention provides an article of manufacture that exhibits superior average Soil Adsorption Values and/or superior total and/or average Mirror Cleaning Visual Grade Values and/or Mirror Cleaning Densitometer Values and/or VFS Absorbent Capacity compared to known articles of manufacture and methods for making such articles of manufacture.

BRIEF DESCRIPTION OF THE DRAWINGS

FIG. 4 is a schematic representation of a sample of article of manufacture used in the Mirror Cleaning Test Method described herein;

FIG. 5 is a schematic representation of 9 individual spectrodensitometer measurement spots on a surface of a mirror for the Mirror Cleaning Test Method;

DETAILED DESCRIPTION OF THE INVENTION

Definitions

Figure 1:
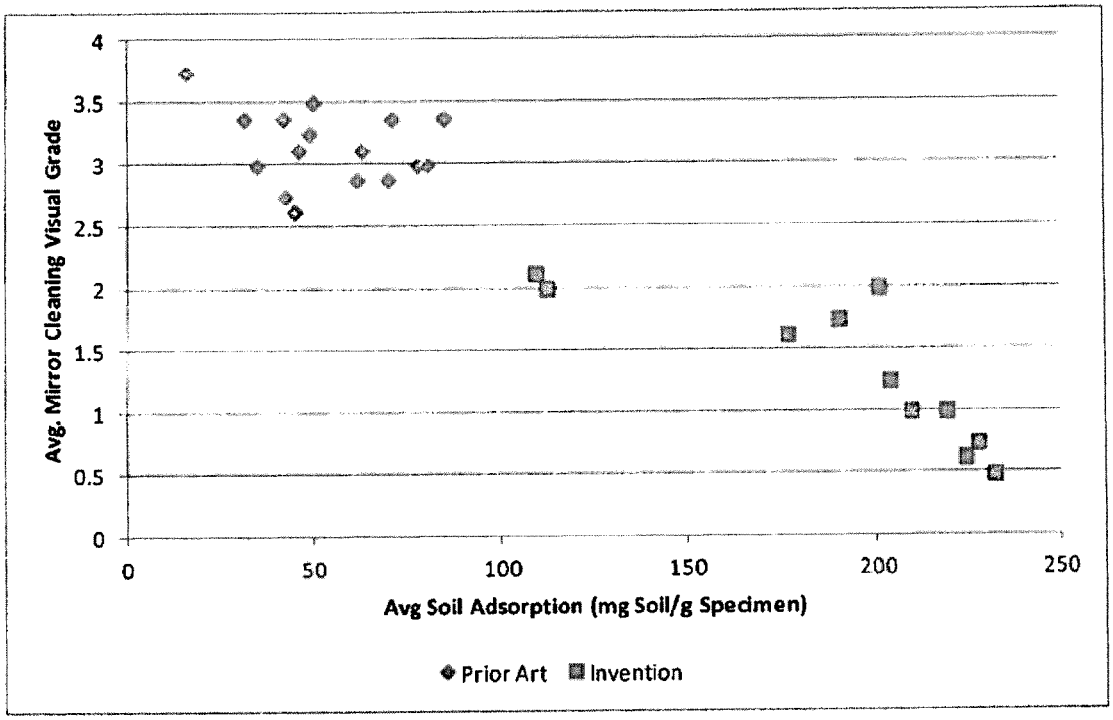
FIG. 1 is a graph showing average Mirror Cleaning Visual Grade Values and average Soil Adsorption Values of articles of manufacture according to the present invention and prior art articles of manufacture.

"Article of manufacture" as used herein means any solid matter, such as a web, foam structure, or particle.

"Web" as used herein means a fibrous structure or a film.

"Fibrous structure" as used herein means a structure that comprises one or more fibrous filaments and/or fibers. In one example, a fibrous structure according to the present invention means an orderly arrangement of filaments and/or fibers within a structure in order to perform a function. Non-limiting examples of fibrous structures of the present invention include paper, fabrics (including woven, knitted, and non-woven), and absorbent pads (for example for diapers or feminine hygiene products).

Non-limiting examples of processes for making fibrous structures include known wet-laid processes, such as wet-laid papermaking processes, and air-laid processes, such as air-laid papermaking processes. Wet-laid and/or air-laid papermaking processes and/or air-laid papermaking processes typically include a step of preparing a composition comprising a plurality of fibers that are suspended in a medium, either wet, more specifically aqueous medium, or dry, more specifically gaseous medium, such as air. The aqueous medium used for wet-laid processes is oftentimes referred to as a fiber slurry. The fiber composition is then used to deposit a plurality of fibers onto a forming wire or belt such that an embryonic fibrous structure is formed, after which drying and/or bonding the fibers together results in a fibrous structure. Further processing the fibrous structure may be carried out such that a finished fibrous structure is formed. For example, in typical papermaking processes, the finished fibrous structure is the fibrous structure that is wound on the reel at the end of papermaking, and may subsequently be converted into a finished product, e.g. a sanitary tissue product.

Another process that can be used to produce the fibrous structures is a melt-blowing and/or spunbonding process where a polymer composition is spun into filaments and collected on a belt to produce a fibrous structure. In one example, a plurality of fibers may be mixed with the filaments prior to collecting on the belt and/or a plurality of fibers may be deposited on a prior produced fibrous structure comprising filaments.

The fibrous structures of the present invention may be homogeneous or may be layered in the direction normal to the machine direction. If layered, the fibrous structures may comprise at least two and/or at least three and/or at least four and/or at least five layers.

The fibrous structures of the present invention may be co-formed fibrous structures. "Co-formed" as used herein means that the fibrous structure comprises a mixture of at least two different components wherein at least one of the components comprises a filament, such as a polypropylene filament, and at least one other component, different from the first component, comprises a solid additive, such as a fiber and/or a particulate. In one example, a co-formed fibrous structure comprises solid additives, such as fibers, such as wood pulp fibers and/or absorbent gel articles of manufacture and/or filler particles and/or particulate spot bonding powders and/or clays, and filaments, such as polypropylene filaments.

"Solid additive" as used herein means a fiber and/or a particulate.

"Particulate" as used herein means a granular substance or powder.

"Fiber" and/or "Filament" as used herein means an elongate particulate having an apparent length greatly exceeding its apparent width, i.e. a length to diameter ratio of at least about 10. In one example, a "fiber" is an elongate particulate as described above that exhibits a length of less than 5.08 cm (2 in.) and a "filament" is an elongate particulate as described above that exhibits a length of greater than or equal to 5.08 cm (2 in.).

Fibers are typically considered discontinuous in nature. Non-limiting examples of fibers include wood pulp fibers and synthetic staple fibers such as polyester fibers.

Filaments are typically considered continuous or substantially continuous in nature. Filaments are relatively longer than fibers. Non-limiting examples of filaments include melt-blown and/or spunbond filaments. Non-limiting examples of articles of manufacture that can be spun into filaments include natural polymers, such as starch, starch derivatives, cellulose and cellulose derivatives, hemicellulose, hemicellulose derivatives, and synthetic polymers including, but not limited to polyvinyl alcohol filaments and/or polyvinyl alcohol derivative filaments, and thermoplastic polymer filaments, such as polyesters, nylons, polyolefins such as polypropylene filaments, polyethylene filaments, and biodegradable or compostable thermoplastic fibers such as polylactic acid filaments, polyhydroxyalkanoate filaments and polycaprolactone filaments. The filaments may be monocomponent or multicomponent, such as bicomponent filaments.

In one example of the present invention, "fiber" refers to papermaking fibers. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. Also applicable to the present invention are fibers derived from recycled paper, which may contain any or all of the above categories as well as other non-fibrous articles of manufacture such as fillers and adhesives used to facilitate the original papermaking.

In addition to the various wood pulp fibers, other cellulosic fibers such as cotton linters, rayon, lyocell and bagasse can be used in this invention. Other sources of cellulose in the form of fibers or capable of being spun into fibers include grasses and grain sources.

"Dry article of manufacture" as used herein means an article of manufacture that comprises less than 30% and/or less than 20% and/or less than 15% and/or less than 10% and/or less than 7% and/or less than 5% and/or less than 3% and/or less than 2% and/or less than 1% and/or less than 0.5% by weight of moisture as measured according to the Moisture Content Test Method described herein.

"Dry web" as used herein means a web that comprises less than 30% and/or less than 20% and/or less than 15% and/or less than 10% and/or less than 7% and/or less than 5% and/or less than 3% and/or less than 2% and/or less than 1% and/or less than 0.5% by weight of moisture as measured according to the Moisture Content Test Method described herein.

"Dry fibrous structure" as used herein means a fibrous structure that comprises less than 30% and/or less than 20% and/or less than 15% and/or less than 10% and/or less than 7% and/or less than 5% and/or less than 3% and/or less than 2% and/or less than 1% and/or less than 0.5% by weight of moisture as measured according to the Moisture Content Test Method described herein.

"Sanitary tissue product" as used herein means a soft, low density (i.e. <about 0.15 g/cm$^3$) web useful as a wiping implement for post-urinary and post-bowel movement cleaning (toilet tissue), for otorhinolaryngological discharges (facial tissue), multi-functional absorbent and cleaning uses (absorbent towels), and folded sanitary tissue products such as napkins and/or facial tissues including folded sanitary tissue products dispensed from a container, such as a box. The sanitary tissue product may be convolutedly wound upon itself about a core or without a core to form a sanitary tissue product roll.

In one example, the sanitary tissue product of the present invention comprises a fibrous structure according to the present invention.

The sanitary tissue products of the present invention may exhibit a basis weight between about 10 g/m$^2$ to about 120 g/m$^2$ and/or from about 15 g/m$^2$ to about 110 g/m$^2$ and/or from about 20 g/m$^2$ to about 100 g/m$^2$ and/or from about 30 to 90 g/m$^2$. In addition, the sanitary tissue product of the present invention may exhibit a basis weight between about 40 g/m$^2$ to about 120 g/m$^2$ and/or from about 50 g/m$^2$ to about 110 g/m$^2$ and/or from about 55 g/m$^2$ to about 105 g/m$^2$ and/or from about 60 to 100 g/m$^2$.

The sanitary tissue products of the present invention may exhibit a total dry tensile strength of at least 59 g/cm (150 g/in) and/or from about 78 g/cm (200 g/in) to about 394 g/cm (1000 g/in) and/or from about 98 g/cm (250 g/in) to about 335 g/cm (850 g/in). In addition, the sanitary tissue product of the present invention may exhibit a total dry tensile strength of at least 196 g/cm (500 g/in) and/or from about 196 g/cm (500 g/in) to about 394 g/cm (1000 g/in) and/or from about 216 g/cm (550 g/in) to about 335 g/cm (850 g/in) and/or from about 236 g/cm (600 g/in) to about 315 g/cm (800 g/in). In one example, the sanitary tissue product exhibits a total dry tensile strength of less than about 394 g/cm (1000 g/in) and/or less than about 335 g/cm (850 g/in). In another example, the sanitary tissue products of the present invention may exhibit a total dry tensile strength of at least 196 g/cm (500 g/in) and/or at least 236 g/cm (600 g/in) and/or at least 276 g/cm (700 g/in) and/or at least 315 g/cm (800 g/in) and/or at least 354 g/cm (900 g/in) and/or at least 394 g/cm (1000 g/in) and/or from about 315 g/cm (800 g/in) to about 1968 g/cm (5000 g/in) and/or from about 354 g/cm (900 g/in) to about 1181 g/cm (3000 g/in) and/or from about 354 g/cm (900 g/in) to about 984 g/cm (2500 g/in) and/or from about 394 g/cm (1000 g/in) to about 787 g/cm (2000 g/in).

The sanitary tissue products of the present invention may exhibit an initial total wet tensile strength of at least 118 g/cm (300 g/in) and/or at least 157 g/cm (400 g/in) and/or at least 196 g/cm (500 g/in) and/or at least 236 g/cm (600 g/in) and/or at least 276 g/cm (700 g/in) and/or at least 315 g/cm (800 g/in) and/or at least 354 g/cm (900 g/in) and/or at least 394 g/cm (1000 g/in) and/or from about 118 g/cm (300 g/in) to about 1968 g/cm (5000 g/in) and/or from about 157 g/cm (400 g/in) to about 1181 g/cm (3000 g/in) and/or from about 196 g/cm (500 g/in) to about 984 g/cm (2500 g/in) and/or from about 196 g/cm (500 g/in) to about 787 g/cm (2000 g/in) and/or from about 196 g/cm (500 g/in) to about 591 g/cm (1500 g/in).

In another example, the sanitary tissue products of the present invention may exhibit an initial total wet tensile strength of less than about 78 g/cm (200 g/in) and/or less than about 59 g/cm (150 g/in) and/or less than about 39 g/cm (100 g/in) and/or less than about 29 g/cm (75 g/in).

The sanitary tissue products of the present invention may exhibit a density (measured at 95 g/in$^2$) of less than about 0.60 g/cm$^3$ and/or less than about 0.30 g/cm$^3$ and/or less than about 0.20 g/cm$^3$ and/or less than about 0.10 g/cm$^3$ and/or less than about 0.07 g/cm$^3$ and/or less than about 0.05 g/cm$^3$ and/or from about 0.01 g/cm$^3$ to about 0.20 g/cm$^3$ and/or from about 0.02 g/cm$^3$ to about 0.10 g/cm$^3$.

The sanitary tissue products of the present invention may exhibit a wet caliper of greater than 10 mils and/or greater than 12 mils and/or greater than 15 mils and/or greater than 20 mils and/or greater than 25 mils and/or greater than 30 mils and/or less than 100 mils and/or less than 75 mils and/or less than 50 mils as measured according to the Wet Caliper Test Method described herein.

The sanitary tissue products of the present invention may exhibit a total absorptive capacity of according to the Horizontal Full Sheet (HFS) Test Method described herein of greater than about 10 g/g and/or greater than about 12 g/g and/or greater than about 15 g/g and/or from about 15 g/g to about 50 g/g and/or to about 40 g/g and/or to about 30 g/g.

The sanitary tissue products of the present invention may exhibit a Vertical Full Sheet (VFS) value as determined by the Vertical Full Sheet (VFS) Test Method described herein of greater than about 5 g/g and/or greater than about 7 g/g and/or greater than about 9 g/g and/or from about 9 g/g to about 30 g/g and/or to about 25 g/g and/or to about 20 g/g and/or to about 17 g/g.

The sanitary tissue products of the present invention may be in the form of sanitary tissue product rolls. Such sanitary tissue product rolls may comprise a plurality of connected, but perforated sheets of fibrous structure, that are separably dispensable from adjacent sheets. In one example, one or more ends of the roll of sanitary tissue product may comprise an adhesive and/or dry strength agent to mitigate the loss of fibers, especially wood pulp fibers from the ends of the roll of sanitary tissue product.

The sanitary tissue products of the present invention may comprises additives such as softening agents, temporary wet strength agents, permanent wet strength agents, bulk softening agents, lotions, silicones, wetting agents, latexes, especially surface-pattern-applied latexes, dry strength agents such as carboxymethylcellulose and starch, and other types of additives suitable for inclusion in and/or on sanitary tissue products.

"Weight average molecular weight" as used herein means the weight average molecular weight $M_w$ (in units of g/mol) as determined using gel permeation chromatography according to the protocol found in Colloids and Surfaces A. Physico Chemical & Engineering Aspects, Vol. 162, 2000, pg. 107-121.

"Number average molecular weight" as used herein means the number average molecular weight $M_n$ (in units of g/mol) as determined using gel permeation chromatography according to the protocol found in Colloids and Surfaces A. Physico Chemical & Engineering Aspects, Vol. 162, 2000, pg. 107-121.

"Polydispersity Index" ("PDI") as used herein means the ratio of the weight average molecular weight to the number average molecular weight, $M_w/M_n$, as determined using gel permeation chromatography.

"Basis Weight" as used herein is the weight per unit area of a sample reported in lbs/3000 $ft^2$ or $g/m^2$ and is measured according to the Basis Weight Test Method described herein.

"By weight of moisture" or "moisture content" means the amount of moisture present in an article of manufacture measured according to the Moisture Content Test Method described herein immediately after the article of manufacture has been conditioned in a conditioned room at a temperature of 73° F.±4° F. (about 23° C.±2.2° C.) and a relative humidity of 50%±10% for 2 hours.

"Machine Direction" or "MD" as used herein means the direction parallel to the flow of The fibrous structure through The fibrous structure making machine and/or sanitary tissue product manufacturing equipment.

"Cross Machine Direction" or "CD" as used herein means the direction parallel to the width of The fibrous structure making machine and/or sanitary tissue product manufacturing equipment and perpendicular to the machine direction.

"Ply" as used herein means an individual, integral fibrous structure.

"Plies" as used herein means two or more individual, integral fibrous structures disposed in a substantially contiguous, face-to-face relationship with one another, forming a multi-ply fibrous structure and/or multi-ply sanitary tissue product. It is also contemplated that an individual, integral fibrous structure can effectively form a multi-ply fibrous structure, for example, by being folded on itself.

"Nonionic monomeric unit" as used herein means a monomeric unit that exhibits no net charge at a pH of 4.5. A nonionic monomeric unit may be derived from nonionic monomer.

"Nonionic monomer" as used herein means a monomer that exhibits no net charge at a pH of 4.5.

"Anionic monomeric unit" as used herein means a monomeric unit that exhibits a net negative charge at a pH of 4.5 and/or at a pH of 6. An anionic monomeric unit may be derived from an anionic monomer. An anionic monomeric unit is generally associated with one or more cations such as cations of alkali metal or alkaline earth metal, for example sodium of cationic groups such as ammonium.

"Anionic monomer" as used herein means a monomer that exhibits a net negative charge at a pH of 4.5 and/or at a pH of 6. An anionic monomer is generally associated with one or more cations such as cations of alkali metal or alkaline earth metal, for example sodium of cationic groups such as ammonium.

"Cationic monomeric unit" as used herein means a monomeric unit that exhibits a net positive charge at a pH of 4.5. A cationic monomeric unit is generally associated with one or more anions such as a chloride ion, a bromide ion, a sulfonate group and/or a methyl sulfate group.

"Cationic monomer" as used herein means a monomer that exhibits a net positive charge at a pH of 4.5. A cationic monomer is generally associated with one or more anions such as a chloride ion, a bromide ion, a sulfonate group and/or a methyl sulfate group.

"Zwitterionic monomeric unit" as used herein means a monomeric unit that exhibits both a negative charge and a positive charge on the same monomeric unit at a pH of 4.5. A zwitterionic monomeric unit is generally associated with one or more cations such as cations of alkali metal or alkaline earth metal, for example sodium or cationic groups such as ammonium and one or more anions such as a chloride ion, a bromide ion, a sulfonate group and/or a methyl sulfate group.

"Zwitterionic monomer" as used herein means a monomer that exhibits both a negative charge and a positive charge on the same monomer at a pH of 4.5. A zwitterionic monomer is generally associated with one or more cations such as cations of alkali metal or alkaline earth metal, for example sodium or cationic groups such as ammonium and one or more anions such as a chloride ion, a bromide ion, a sulfonate group and/or a methyl sulfate group.

Article of Manufacture

A non-limiting example of an article of manufacture of the present invention includes a dry article of manufacture, for example a dry fibrous structure such as a dry paper towel, rather than a pre-moistened, liquid composition-containing towel or wipe or pad, that exhibits improved and/or superior average Soil Adsorption Values as measured according to the Soil Adsorption Test Method and/or improved and/or superior average Mirror Cleaning Visual Grade Values and/or improved and/or superior total Mirror Cleaning Visual Grade Values and/or improved and/or superior average Mirror Cleaning Densitometer Values and/or improved and/or superior total Mirror Cleaning Densitometer Values as measured according to the Mirror Cleaning Test Method described herein and/or improved and/or superior VFS Absorptive Capacity as measured according to the VFS Test Method described herein compared to known articles of manufacture.

The article of manufacture of the present invention may exhibit an average Soil Adsorption Value of about 90 mg soil/g article of manufacture or greater and/or about 95 mg soil/g article of manufacture or greater and/or about 100 mg soil/g article of manufacture or greater and/or 105 mg soil/g article of manufacture or greater and/or about 110 mg soil/g article of manufacture or greater and/or about 125 mg soil/g article of manufacture or greater and/or about 150 mg soil/g article of manufacture or greater and/or about 170 mg soil/g article of manufacture or greater and/or about 200 mg soil/g article of manufacture or greater and/or about 210 mg soil/g article of manufacture or greater and/or about 220 mg soil/g article of manufacture or greater as measured according to the Soil Adsorption Test Method described herein.

In another example, the article of manufacture of the present invention may exhibit an average Mirror Cleaning Visual Grade Value of less than 2.5 and/or less than 2.25 and/or less than 2 and/or less than 1.75 and/or less than 1.50 and/or less than 1.25 and/or less than 1 and/or less than 0.75 to 0 and/or to about 0 and/or to about 0.25 as measured by the Mirror Cleaning Test Method described herein.

In still another example of the present invention, the article of manufacture may exhibit a total Mirror Cleaning Visual Grade Value of less than 10 and/or less than 9.5 and/or less than 9.0 and/or less than 8.5 and/or less than 8 and/or less than 7.5 and/or less than 7 and/or less than 6.5 and/or less than 6 and/or less than 5.5 and/or less than 5 and/or less than 4.5 and/or less than 4 and/or to about 0.5 and/or to about 1 and/or to about 1.5 as measured according to the Mirror Cleaning Test Method described herein.

In another example, the article of manufacture may exhibit an average Mirror Cleaning Densitometer Value of −0.46 or greater and/or −0.42 or greater and/or −0.38 or greater and/or −0.34 or greater and/or −0.30 or greater and/or −0.25 or greater and/or −0.20 or greater as measured by the Mirror Cleaning Test Method described herein.

In still another example of the present invention, the article of manufacture may exhibit a total Mirror Cleaning Densitometer Value of −1.82 or greater and/or −1.75 or greater and/or −1.60 or greater and/or −1.50 or greater and/or −1.35 or greater and/or −1.20 or greater as measured according to the Mirror Cleaning Test Method described herein.

In one example, the article of manufacture comprises a web. In another example, the article of manufacture comprises a particle.

When the article of manufacture comprises a web, the web may comprise a fibrous structure. The fibrous structure may be a dry fibrous structure.

The fibrous structure of the present invention may comprise a plurality of pulp fibers. Further, the fibrous structure of the present invention may comprise a single-ply or multi-ply sanitary tissue product, such as a paper towel.

In another example, the article of manufacture of the present invention may comprise a web, for example a fibrous structure, in the form of a cleaning pad suitable for use with a cleaning device, such as a floor cleaning device, for example a Swiffer® cleaning pad or equivalent cleaning pads.

In still another example, the article of manufacture of the present invention may comprise a foam structure.

The article of manufacture of the present invention may comprise a soil adsorbing agent. When present, the soil adsorbing agent may be present in and/or on the article of manufacture at a level of greater than 0.005% and/or greater than 0.01% and/or greater than 0.05% and/or greater than 0.1% and/or greater than 0.15% and/or greater than 0.2% and/or less than 5% and/or less than 3% and/or less than 2% and/or less than 1% by weight of the article of manufacture. In one example, the soil adsorbing agent is present in and/or on the article of manufacture at a level of from about 0.005% to about 1% by weight of the article of manufacture.

In another example of the present invention, an article of manufacture may comprise a soil adsorbing agent at a level of greater than 0.1 pounds/ton (#/ton) and/or greater than 1 #/ton and/or greater than 2 #/ton and/or greater than 3 #/ton and/or less than 20 #/ton and/or less than 15 #/ton and/or less than 10 #/ton by weight of the article of manufacture. The level of soil adsorbing agent present in and/or on an article of manufacture as used herein according to the present invention is in terms of active solids basis of the soil adsorbing agent.

The article of manufacture may comprise other ingredients in addition to the soil adsorbing agent, for example a surfactant. The surfactant may be present in the article of manufacture at a level of from about 0.01% to about 0.5% by weight of the article of manufacture. Non-limiting examples of a suitable surfactant include $C_{8-16}$ alkyl polyglucoside, cocoamido propyl sulfobetaine or mixtures thereof.

In one example, the article of manufacture comprises a signal, such as a dye and/or pigment that becomes visible or becomes invisible to a consumer's eye when the article of manufacture adsorbs soil and/or when a soil adsorbing agent present in and/or on the article of manufacture adsorbs soil. In another example, the signal may be a difference in texture of the article of manufacture or a difference in the physical state of the article of manufacture, for example the article of manufacture dissolves and/or vaporizes when the article of manufacture adsorbs soil.

In another example, the soil adsorbing agent may be present in and/or on an article of manufacture in a pattern, such as a non-random repeating pattern composing lines and or letters/words, and/or present in and/or on regions of different density, different basis weight, different elevation and/or different texture of the article of manufacture.

In still another example of the present invention, the article of manufacture may provide a residual cleaning effect as measured according to the Mirror Cleaning Test Method described herein on a surface, such as a mirror, after adsorbing at least a portion of the soil previously present on the surface. Without being bound by theory, it is believed that this residual cleaning effect, which at least partially inhibits at least some soils from collecting and/or remaining on the surface, results from at least a portion of the soil adsorbing agent depositing on the surface and remaining on the surface after cleaning with the article of manufacture.

In yet another example, the article of manufacture, for example a dry fibrous structure, of the present invention comprising a polymer, for example a soil adsorbing agent, such as a cationic soil adsorbing agent, of the present invention, may exhibit an improved absorbency compared to known articles of manufacture. Without being bound by theory, it is believed that the presence of the soil adsorbing agent, for example a soil adsorbing agent exhibiting a net positive charge, in, in between plies of the article of manufacture and/or on one or more surfaces of the article of manufacture increases the absorbent properties of the article of manufacture, for example the VFS Absorptive Capacity to provide a VFS of greater than 11 g/g and/or greater than 13 g/g and/or greater than 17 g/g. In another example, the article of manufacture, for example dry fibrous structures, of the present invention comprising a polymer, for example a soil adsorbing agent, such as a cationic soil adsorbing agent, of the present invention, may exhibit an improved absorbency compared to the same article of manufacture without any soil adsorbing agent. Without being bound by theory, it is believed that the presence of the soil adsorbing agent, for example a soil adsorbing agent exhibiting a net positive charge, in, in between plies of the article of manufacture and/or on one or more surfaces the article of manufacture increases the absorbent properties of the article of manufacture, for example the VFS Absorptive Capacity to provide a VFS Absorptive Capacity increase as compared to the same article of manufacture without any soil adsorbing agent of at least 1 g/g and/or at least 1.3 g/g and/or at least 1.5 g/g and/or at least 2 g/g and/or at least 2.5 g/g and/or at least 3 g/g and/or at least 4 g/g and/or at least 5 g/g and/or at least 6 g/g and/or at least 7 g/g as measured according to the VFS Test Method described herein.

It has been surprisingly found that cationic soil adsorbing agents, such as cationic polyacrylamide soil adsorbing agents, examples of which are commercially available from Hychem, Inc. under the tradename Hyperfloc® CE834 and CE1954. Hyperfloc® CE834 and CE1954 are inverse emulsions when applied directly to an article of manufacture, such as a fibrous structure, for example a dry paper towel, without first inverting the inverse emulsion provides an increase in VFS Absorbent Capacity compared to the same article of manufacture without any soil adsorbing agent as measured according to the VFS Test Method. For clarity, a conventional emulsion is an oil-in-water emulsion where the water is the continuous phase and the oil is the dispersed phase and an inverse emulsion is a water-in-oil phase where the water is the dispersed phase and the oil is the continuous phase. This VFS Absorbent Capacity increase is in addition to the soil adsorbing benefits and/or cleaning performance benefits resulting from the inclusion of the soil adsorbing agent in the article of manufacture. Furthermore, this VFS Absorbent Capacity benefit is achieved without the dry dusting and escape of visible absorbent gel particles common with attempts to add superabsorbent powders to articles of manufacture, such as dry fibrous structure. Further yet, the application of these same cationic soil adsorbing agents on a wet-end of a paper machine for making a dry fibrous structure following a manufacturer's recommendation to invert the emulsion to form a dilute aqueous solution of un-coiled soil adsorbing agent polymer does not provide the VFS Absorbent Capacity benefit observed above. Without wishing to be bound by theory, it is believed that direct application of an inverse emulsion, for example Hyperfloc® CE834 or CE1954, deposits highly coiled polymer droplets of a size of less than about 1 μm diameter onto one or more external and/or internal surfaces of an article of manufacture, for example a dry fibrous structure such as a dry paper towel. These highly coiled polymer droplet particles are likely too small to be detected on the surface of the article of manufacture and/or the swollen particles are likely too small to be observed visually, furthermore, the effective addition rate of the soil adsorbing agent to the article of manufacture as described above, minimizes any slippery feel typically associated with superabsorbent particles. Addition of the soil adsorbing agent to internal surfaces of an article of manufacture, such as between plies of a multi-ply paper towel, can further minimize the slippery feel and may permit higher addition rates.

Table 1 below shows the VFS Absorbent Capacity benefit of several soil adsorbing agent-containing paper towels.

TABLE 1

| Soil Adsorbing Agent | Level of Soil Adsorbing Agent # active/ton | Addition Point | Surface or Between Plies | VFS (g/g) |
|---|---|---|---|---|
| Control | NA | NA | NA | 9.80 |
| Nonionic (Hyperfloc NE823) | 2 | Dry-end | Surface | 9.83 |
| Nonionic (Hyperfloc NE823) | 4 | Dry-end | Surface | 10.00 |
| Cationic (Hyperfloc CE834) | 1 | Dry-end | Surface | 11.37 |
| Cationic (Hyperfloc CE834) | 2 | Dry-end | Surface | 12.77 |
| Cationic (Hyperfloc CE1954) | 1 | Dry-end | Surface | 10.97 |
| Cationic (Hyperfloc CE1954) | 2 | Dry-end | Surface | 12.00 |
| Cationic (Hyperfloc CE834) | 2 | Wet-end | Surface | 9.23 |
| Control | NA | NA | NA | 9.23 |
| Hyperfloc NE823 | 2 | Dry-end | Surface | 9.36 |
| Hyperfloc NE823 | 4 | Dry-end | Between | 10.12 |
| Hyperfloc CE1954 | 2 | Dry-end | Between | 13.00 |
| Hyperfloc CE1954 | 4 | Dry-end | Between | 18.47 |

Table 2 below shows individual Mirror Cleaning Visual Grade ("Visual") Values and Mirror Cleaning Densitometer ("Density") Values and average Mirror Cleaning Visual Grade ("Visual") Values and average Mirror Cleaning Densitometer ("Density") Values for articles of manufacture, in this case dry fibrous structures (e.g., paper towels) (Inventions A-I with their respective soil adsorbing agents) in accordance with the present invention and of known articles of manufacture, such as dry fibrous structures (e.g., paper towels), as measured according to the Mirror Cleaning Test Method described herein.

TABLE 2

| | Mirror 1 Mirror Cleaning Visual Grade Value | | Mirror 2 Mirror Cleaning Visual Grade Value | | Mirror 3 Mirror Cleaning Visual Grade Value | | Mirror 4 Mirror Cleaning Visual Grade Value | | Avg. Mirror Cleaning Visual Grade Value | |
|---|---|---|---|---|---|---|---|---|---|---|
| Article of manufacture | Visual Grade | Density | Visual Grade | Density | Visual Grade | Density | Visual Grade | Density | Visual Grade | Density |
| Invention A (MVF1961-039 @ 6#/ton) | 0.5 | −0.04 | 0.5 | −0.03 | 0.5 | −0.16 | 1.5 | −0.38 | 0.75 | −0.14 |

TABLE 2-continued

| | Mirror 1 Mirror Cleaning Visual Grade Value | | Mirror 2 Mirror Cleaning Visual Grade Value | | Mirror 3 Mirror Cleaning Visual Grade Value | | Mirror 4 Mirror Cleaning Visual Grade Value | | Avg. Mirror Cleaning Visual Grade Value | |
|---|---|---|---|---|---|---|---|---|---|---|
| Article of manufacture | Visual Grade | Density | Visual Grade | Density | Visual Grade | Density | Visual Grade | Density | Visual Grade | Density |
| Invention B (MVF1961-039 @ 2#/ton) | 0.5 | −0.03 | 1 | −0.08 | 1 | −0.26 | 1.5 | −0.45 | 1.00 | −0.21 |
| Invention C (Hyperfloc ® NE823F @ 1#/ton) | 1 | −0.25 | 0.5 | −0.04 | 0.5 | −0.21 | 0.5 | −0.34 | 0.63 | −0.21 |
| Invention D (Hyperfloc ® NE823F @, 2#/ton) | 0.5 | −0.03 | 0 | −0.08 | 0.5 | −0.29 | 1 | −0.48 | 0.50 | −0.22 |
| Invention E (Mirapol HSC-300 ®, 5#/ton) | 2 | −0.27 | 1 | −0.21 | 1 | −0.27 | 2.5 | −0.50 | 1.63 | −0.31 |
| Invention F (Hyperfloc ® CE1954, 2#/ton) | 0.5 | −0.11 | 1.5 | −0.27 | 2 | −0.37 | 3 | −0.55 | 1.75 | −0.33 |
| Invention G (Mirapol HSC-300 ® Wet-end Addition, 10 #/ton) | 1.5 | −0.36 | 1.5 | −0.27 | 2 | −0.32 | 3 | −0.58 | 2.00 | −0.38 |
| Invention H (Hyperfloc ® CE1954, Wet-end addition, 4#/ton) | 1.5 | −0.28 | 1 | −0.24 | 2.5 | −0.46 | 3.5 | −0.84 | 2.13 | −0.46 |
| Invention I (MVF1562-100B, 6#/ton) | 0.5 | −0.17 | 0.5 | −0.10 | 1.5 | −0.28 | 2.5 | −0.51 | 1.25 | −0.27 |
| Bounty ® | 2.5 | −0.57 | 3 | −0.63 | 4 | −1.00 | 4 | −1.05 | 3.38 | −0.81 |
| Bounty ® (Lupasol P, 4#/ton, pH 4.5) | 2.5 | −0.45 | 2.5 | −0.54 | 3 | −0.59 | 4 | −0.98 | 3.00 | −0.64 |
| Bounty ® Basic | 2 | −0.40 | 2.5 | −0.56 | 3.5 | −0.92 | 4 | −1.14 | 3.00 | −0.76 |
| Viva ® | 2.5 | −0.73 | 2.5 | −0.54 | 3 | −0.56 | 3.5 | −0.82 | 2.88 | −0.66 |
| Kroger ® Nice and Strong | 3 | −0.70 | 2.5 | −0.50 | 4 | −1.00 | 4 | −1.15 | 3.38 | −0.84 |
| Meijer ® Premium | 2.5 | −0.62 | 3 | −0.61 | 3.5 | −0.88 | 4 | −1.29 | 3.25 | −0.85 |
| Kroger ® Everyday | 1.5 | −0.32 | 2.5 | −0.59 | 4 | −0.86 | 4 | −1.12 | 3.00 | −0.72 |
| Meijer ® Regular | 3 | −0.74 | 4 | −0.92 | 4 | −1.11 | 4 | −1.18 | 3.75 | −0.99 |
| Marcal ® Small steps | 2.5 | −0.78 | 3 | −0.53 | 4 | −0.88 | 4 | −1.12 | 3.38 | −0.83 |
| Sparkle ® | 2 | −0.39 | 1.5 | −0.39 | 3.5 | −0.84 | 4 | −1.03 | 2.75 | −0.66 |
| Scott ® Towels | 3 | −0.61 | 3 | −0.70 | 4 | −1.14 | 4 | −1.43 | 3.5 | −0.97 |
| Target ® | 2 | −0.48 | 2.5 | −0.55 | 3 | −0.86 | 4 | −0.98 | 2.88 | −0.72 |
| Brawny ® | 1.5 | −0.20 | 2 | −0.27 | 3 | −0.57 | 4 | −0.87 | 2.63 | −0.48 |
| Thrifty Maid ® | 1.5 | −0.27 | 3 | −0.78 | 4 | −0.94 | 4 | −0.93 | 3.13 | −0.73 |
| Sam's Club ® | 2 | −0.43 | 3.5 | −0.82 | 4 | −1.21 | 4 | −1.41 | 3.38 | −0.97 |
| Kirkland ® GP | 3 | −0.50 | 2.5 | −0.28 | 3 | −0.56 | 4 | −0.88 | 3.13 | −0.56 |

Table 3 below shows average Soil Adsorption values (based on 238 mg of soil/g article of manufacture) for articles of manufacture, in this case dry fibrous structures (e.g., paper towels) (Inventions A-I with their respective soil adsorbing agents) in accordance with the present invention and of known articles of manufacture, such as dry fibrous structures (e.g., paper towels), as measured according to the Soil Adsorption Test Method described herein.

TABLE 3

| Article of manufacture | Avg. Soil Adsorption Value (mg soil/g article of manufacture) | Avg. Soil Adsorption Values Stdev |
|---|---|---|
| Invention A (MVF1961-039 @ 6#/ton) | 226.6 | 2.66 |
| Invention B (MVF1961-039 @ 2#/ton) | 209.3 | 2.89 |
| Invention C (Hyperfloc ® NE823F @ 1#/ton) | 223.3 | 6.52 |
| Invention D (Hyperfloc ® NE823F @, 2#/ton) | 231.5 | 2.71 |
| Invention E (Mirapol HSC-300 ® 5#/ton) | 176.2 | 7.58 |
| Invention F (Hyperfloc ® CEI954, 2#/ton) | 189.7 | 6.03 |
| Invention G (Mirapol HSC-300 ® Wet-end Addition, 10 #/ton) | 112.0 | 4.48 |
| Invention H (Hyperfloc ® CE1954, Wet-end addition, 4#/ton) | 109.2 | 2.69 |
| Invention I (MVF1562-100B, 6#/ton NE823, 2#/ton Replicate) | 202.9 | 5.84 |
| Bounty ® | 84.8 | 2.9 |

TABLE 3-continued

| Article of manufacture | Avg. Soil Adsorption Value (mg soil/g article of manufacture) | Avg. Soil Adsorption Values Stdev |
|---|---|---|
| Bounty ® (Lupasol P, 4#/ton, pH4.5) | 80.3 | 4.02 |
| Bounty ® Basic | 77.4 | 3.20 |
| Viva ® | 61.1 | 4.6 |
| Kroger ® Nice and Strong | 70.5 | 5.5 |
| Meijer ® Premium | 48.6 | 4.75 |
| Kroger ® Everyday | 35.0 | 4.9 |
| Meijer ® Regular | 15.9 | 1.19 |
| Marcal ® Small steps | 31.1 | 3.78 |
| Sparkle ® | 42.3 | 1.5 |
| Scott ® Towels | 49.8 | 2.8 |
| Target ® | 69.6 | 3.19 |
| Brawny ® | 44.6 | 7.67 |
| Thrifty Maid ® | 45.8 | 2.66 |
| Sam's Club ® | 41.7 | 3.0 |
| Kirkland ® GP | 62.7 | 4.1 |

In another example, an article of manufacture of the present invention may be derived from an article of manufacture, such as any fibrous structure, for example a paper towel, that with or without a soil adsorbing agent exhibits an average Soil Adsorption Value that is less than 90 mg soil/g article of manufacture as measured according to the Soil Adsorption Test Method described herein and/or an average Mirror Cleaning Visual Grade Value of greater than −0.46 as measured according to the Mirror Cleaning Test Method described herein and/or a total Mirror Cleaning Visual Grade Value of less than 10 as measured according to the Mirror Cleaning Test Method as described herein to which a soil adsorbing agent is applied in order to achieve the Soil Adsorption Values and/or Mirror Cleaning Visual Grade Values of the present invention. Table 4 below exemplifies comparative examples of articles of manufacture without soil adsorbing agents and the same articles of manufacture with soil adsorbing agents according to the present invention, wherein the soil adsorbing agents have been applied directly to the article of manufacture, such as a finished fibrous structure, for a example a commercially available paper towel.

TABLE 4

| Article of manufacture | Mirror Cleaning Visual Grade | | | | Avg. Mirror Cleaning Visual Grade | Avg. Soil Adsorption Value (mg soil/g article of manufacture) | Avg. Soil Adsorption Value Stdev |
|---|---|---|---|---|---|---|---|
| | Mirror 1 | Mirror 2 | Mirror 3 | Mirror 4 | | | |
| Kroger ® Nice and Strong | 3.5 | 3.5 | 4 | 4 | 3.75 | 71.9 | 4.3 |
| Kroger ® Nice and Strong (Hyperfloc ® NE823) | 0.5 | 1 | 2.5 | 3 | 1.75 | 220.1 | 7.2 |
| Kroger ® Everyday | 3 | 3 | 4 | 4 | 3.5 | 50.5 | 9.5 |
| Kroger ® Everyday (Hyperfloc ® NE823) | 0.5 | 0.5 | 1 | 3 | 1.25 | 196.9 | 13.0 |
| Marcal ® Small steps | 3 | 3 | 3.5 | 4 | 3.375 | 36 | 11.7 |
| Marcal ® Small steps (Hyperfloc ® NE823) | 0.5 | 0.5 | 1 | 2 | 1 | 199.3 | 18.7 |

Polymers

The polymers of the present invention may comprise a soil adsorbing agent. The soil adsorbing agent (polymer) may be any suitable chemical that when applied to and/or present within an article of manufacture of the present invention provides the article of manufacture with an average Soil Adsorption Value and/or average Mirror Cleaning Visual Grade Value and/or total Mirror Cleaning Visual Grade Value and/or average Mirror Cleaning Densitometer Value and/or total Mirror Cleaning Densitometer Value as described herein.

In one example, the soil adsorbing agent exhibits a charge density (at pH 4.5) (an excess charge density) of less than 10 meq/g and/or less than 7 meq/g and/or less than 5 meq/g and/or less than 3 meq/g and/or less than 2 meq/g and/or to about 0 meq/g and/or to about 0.1 meq/g and/or to about 0.2 meq/g as measured according to the Charge Density Test Method described herein. In one example, the soil adsorbing agent exhibits a charge density (an excess charge density) of from about 0 to less than 0.1 meq/g and/or less than 0.05 meq/g. The charge densities of a few non-limiting examples of soil adsorbing agents of the present invention follow: Hyperfloc® CE1954 has a charge density of +2.29 meq/g; Hyperfloc® CE834 has a charge density of +1.35 meq/g; Hyperfloc® NE823 has a charge density of −0.2 meq/g; and Mirapol® HSC-300 has a charge density of +1.75 meq/g as measured according to the Charge Density Test Method described herein.

In one example, the soil adsorbing agent exhibits a weight average molecular weight of greater than 750,000 and/or greater than 1,500,000 and/or greater than 4,000,000 and/or to about 40,000,000 and/or to about 20,000,000 and/or to about 10,000,000.

In another example, the soil adsorbing agent exhibits a number average molecular weight of greater than 200,000 g/mol and/or greater than 500,000 g/mol and/or greater than 750,000 g/mol and/or greater than 900,000 g/mol to less than 2,000,000 g/mol and/or less than 1,750,000 g/mol and/or less than 1,500,000 g/mol. In one example, the soil adsorbing agent exhibits a number average molecular weight of from about 500,000 g/mol to about 2,000,000 g/mol and/or from about 900,000 g/mol to about 1,700,000 g/mol.

Non-limiting examples of suitable chemicals include polymers. In one example, the soil adsorbing agent comprises a polymer comprising monomeric units derived from acrylic acid and/or quaternary ammonium compounds and/or acrylamide. In one example, polyethyleneimines, such as Lupasol®, which is commercially available from BASF Corporation, are not suitable as soil adsorbing agents within the present invention.

In one example, the soil adsorbing agent comprises a flocculating agent as compared to a coagulating agent.

A flocculating agent is a chemical that results in colloids and other suspended particles, especially in liquids, to aggregate. An example of a flocculating agent according to the present invention is Rhodia's Mirapol®.

A coagulating agent on the other hand, for purposes of the present invention is a chemical that results in a liquid changing into a thickened solid. An example of a coagulating agent according to the present invention is BASF Corporation's Lupasol®.

In one example, the soil adsorbing agent comprises a homopolymer of polyacrylamide, such as Hyperfloc®, which is commercially available from Hychem, Inc.

In one example, the soil adsorbing agent may be used as a highly concentrated inverse emulsion (for example a water-in-oil emulsion), containing greater than 10% and/or greater than 15% and/or greater than 20% and/or greater than 25% and/or greater than 30% and/or greater than 35% and/or to about 60% and/or to about 55% and/or to about 50% and/or to about 45% active. The oil phase may consist of high quality mineral oil with boiling point range of 468-529° F. or a heavy mineral oil with boiling point range of 608-968° F. In another example the soil adsorbing agents may be used as a highly concentrated dewatered emulsion for example dry particles suspended in a continuous oil phase, containing greater than 10% and/or greater than 15% and/or greater than 20% and/or greater than 25% and/or greater than 30% and/or greater than 35% and/or to about 60% and/or to about 55% and/or to about 50% and/or to about 45% active. The oil phase may consist of high quality mineral oil with boiling point range of 468-529° F. or a heavy mineral oil with boiling point range of 608-968° F. In one example, the soil adsorbing agent may be used as a highly concentrated inverse emulsion wherein the continuous phase of the inverse emulsion comprises mineral oil, such as white mineral oil.

In still another example, soil adsorbing agent may be used as a dewatered inverse emulsion, such as ND823, AD589, and CD864, which are commercially available from SNF Floerger, which consist of micron size particles of highly coiled polymer in a continuous oil phase.

The inverse emulsions of the present invention may be directly applied to a surface of an article of manufacture, such as a surface of a dry fibrous structure, a surface of a wet fibrous structure and/or added to the wet-end of a papermaking process.

The soil adsorbing agents may be anionic, neutral and/or cationic under pH 4.5 conditions. In one example, the soil adsorbing agent comprises a quaternary ammonium compound under pH 4.5 conditions. In another example, the soil adsorbing agent comprises an amine under pH 4.5 conditions. In still another example, the soil adsorbing agent comprises an acrylamide under pH 4.5 conditions.

The soil adsorbing agent may comprise a polymer comprising one or more monomeric units derived from quaternary ammonium compounds, amine compounds, acrylamide compounds, acrylic acid compounds and mixtures thereof at various weight ratios within the polymer.

In another example, the soil adsorbing agent as shown in Formula I below comprises a copolymer of acrylic acid and a quaternary ammonium compound, such as a diquaternary ammonium:

I

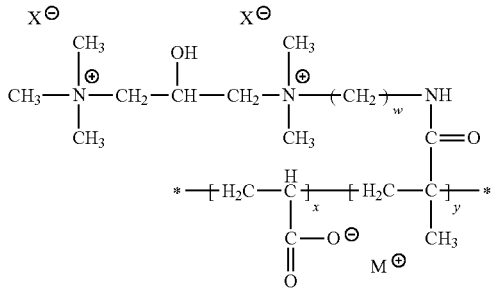

where w is an integer from 1 to 20 and/or from 2 to 15 and/or from 3 to 10; x is an integer from 1 to 100 and/or from 5 to 75 and/or from 10 to 50; y is an integer from 1 to 100 and/or from 5 to 75 and/or from 10 to 50; $X^-$ is a suitable anion such as $Cl^-$; and $M^+$ is a suitable cation such as $Na^+$. An example of such a soil adsorbing agent is commercially from Rhodia under the trade name Mirapol®.

In another example, the polycationic polymer comprises a copolymer comprising:

a) at least a monomer of the general formula i:

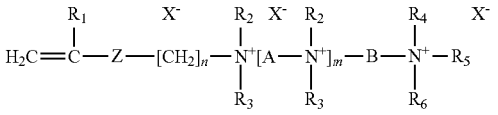

i in which $R_1$ is a hydrogen atom, a methyl or ethyl group; $R_2$, $R_3$, $R_4$, $R_5$ and $R_6$, which are identical or different, are linear or branched $C_1$-$C_6$, alkyl, hydroxyalkyl or aminoalkyl groups; m is an integer from 0 to 10; n is an integer from 1 to 6; Z represents a —C(O)O— or —C(O)NH— group or an oxygen atom; A represents a $(CH_2)_p$ group, p being an integer from 1 to 6; B represents a linear or branched $C_2$-$C_{12}$, polymethylene chain optionally interrupted by one or more heteroatoms or heterogroups, and optionally substituted by one or more hydroxyl or amino groups; $X^-$, which are identical or different, represent counterions; and (b) at least one hydrophilic monomer carrying a functional acidic group which is copolymerizable with (a) and which is capable of being ionized in the application medium;

(c) optionally at least one monomer compound with ethylenic unsaturation with a neutral charge which is copolymerizable with monomer (a) and monomer (b).

The monomer (a) may be such that Z represents —C(O)O—, —C(O)NH— or O atom; n is equal to 2 or 3; m ranges from 0 to 2; represents $—CH_2—CH(OH)—(CH_2)_q$, with q from 1 to 4; and $R_1$ to $R_6$, which are identical or different, represent a methyl or ethyl group.

The copolymer may further comprise at least one monomer compound with ethylenic unsaturation with a neutral charge which is copolymerizable with monomer (a) and monomer (b).

Monomer (c) may be a hydrophilic monomer compound with ethylenic unsaturation with a neutral charge, carrying one or more hydrophilic groups, which is copolymerizable with monomer (a) and monomer (b).

Monomer (b) may be a $C_3$-$C_8$ carboxylic, sulfonic, sulfuric, phosphoric or phosphoric acids with monoethylenic unsaturation.

The copolymer may obtained by copolymerization of 3 to 80 mol %, of the monomer (a); of 10 to 95 mol %, of the monomer (b); and 0 to 50 mol %, of the monomer (c).

Monomer (a) and monomer (b) may exhibit a molar ratio by weight of the total of the monomer (a) to the total of the monomers (b) of between 80/20 and 5/95.

The copolymer may further comprise at least one monomer (d) having the general formula ii:

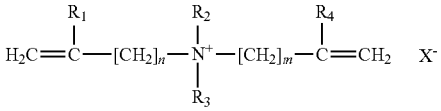

ii in which $R_1$ and $R_4$ independently represent H or a $C_1$-$C_6$ linear or branched alkyl group; $R_2$ and $R_3$ independently represent a linear or branched $C_1$-$C_6$ alkyl, hydroxyalkyl or aminoalkyl group, preferably a methyl group; n and m are integers of between 1 and 3; $X^-$ represents a counterion compatible with the water-soluble or water-dispersible nature of the polymer.

In one example, the copolymer may further comprise at least one hydrophilic monomer (e) with an acid functionality. Non-limiting examples of such a hydrophilic monomer (e) include $C_3$-$C_8$ carboxylic, sulfonic, sulfuric, phosphonic and phosphoric acids containing monoethylenic unsaturation monomers.

The copolymer may further comprise an ethylenically unsaturated hydrophilic monomer (f) compound of neutral charge bearing one or more hydrophilic groups. Non-limiting examples of such an ethylenically unsaturated hydrophilic monomer include acrylamide, vinyl alcohol, $C_1$-$C_4$ alkyl esters of acrylic acid and of methacrylic acid, $C_1$-$C_4$ hydroxyalkyl esters of acrylic acid and of methacrylic acid, in particular ethylene glycol and propylene glycol acrylate and methacrylate, polyalkoxylated esters of acrylic acid and of methacrylic acid, in particular the polyethylene glycol and polypropylene glycol esters.

In one example, the soil adsorbing agent comprises a polymer as described below. The polymers of the present invention comprise several monomeric units thus it can be referred to as a copolymer rather than a homopolymer, which consists of a single type of monomeric unit. The polymers of the present invention may be a terpolymer (3 different monomeric units). The polymers of the present invention may be a random copolymer. In one example, a polymer of the present invention is water-soluble soluble and/or water-dispersible, which means that the polymer does not, over at least a certain pH and concentration range, form a two-phase composition in water.

In one example, the polymers exhibit a Number Average Molecular Weight of less than 2,000,000 g/mol and/or less than 1,750,000 g/mol and/or less than 1,700,000 g/mol and/or less than 1,500,000 g/mol and/or greater than 500,000 g/mol and/or greater than 900,000 g/mol. In another example, the polymers exhibit a Number Average Molecular Weight of from about 500,000 to 2,000,000 g/mol and/or from about 900,000 to 1,700,000 g/mol.

In one example, the polymers exhibit an excess charge of from about 0 to less than 0.1 meq/g and/or of less than 0.05 meq/g as measured according to the Charge Density Test Method described herein.

In another example, the polymers exhibit a Polydispersity Index of less than 2.5 and/or of less than 2.0 and/or less than 1.7 and/or less than 1.5.

In one example, a polymer of the present invention comprises two or more monomeric units selected from the group consisting of: a. nonionic monomeric units; b. anionic monomeric units; c. cationic monomeric units; d. zwitterionic monomeric units; and e. mixtures thereof.

In one example, the polymer comprises at least one monomeric unit selected from groups a and b and at least one monomeric unit selected from groups c and d above.

In one example, the polymer comprises at least 70% wt of a monomeric unit from group a.

In one example, the polymer comprises at least 0.1% wt of a monomeric unit from group b.

In one example, polymer comprises at least 0.3% wt of a monomeric unit from group c.

In one example, polymer comprises at least 0.5% wt of a monomeric unit from group d.

In one example, the polymer comprises at least 70% wt of a monomeric unit from group a and no more than 30% wt of a monomeric unit selected from the group consisting of: group b, group c, group d, and mixtures thereof.

In another example, the polymer comprises no more than 30% wt of a monomeric unit selected from the group consisting of: group b, group c, group d, and mixtures thereof.

In one example, the polymer may comprise a monomeric unit from group a and a monomeric unit from group b.

In one example, the polymer may comprise a monomeric unit from group a and a monomeric unit from group c.

In another example, the polymer of the present invention may comprise a monomeric unit from group a and a monomeric unit from group d.

In still another example, the polymer of the present invention may comprise a monomeric unit from group b and a monomeric unit from group c.

In still another example, the polymer of the present invention may comprise a monomeric unit from group b and a monomeric unit from group d.

In yet another example, the polymer of the present invention may comprise a monomeric unit from group a, a monomeric unit from group b, and a monomeric unit from group c.

In even another example, the polymer of the present invention may comprise a monomeric unit from group a, a monomeric unit from group b, and a monomeric unit from group d.

In yet another example, the polymer of the present invention may comprise a monomeric unit from group a, a monomeric unit from group c, and a monomeric unit from group d.

In another example, the polymer of the present invention may comprise a monomeric unit from group b, a monomeric unit from group c, and a monomeric unit from group d.

In even yet another example, the polymer of the present invention may comprise a monomeric unit from group a, a monomeric unit from group b, a monomeric unit from group c and a monomeric unit from group d.

In one example, when present in the polymer, the monomeric unit from group b and the monomeric unit from group c are present in the polymer at a molar ratio of from about 3:1 to 1:3 and/or from about 2:1 to 1:2 and/or from about 1.3:1 to 1:1.3 and/or about 1:1 or less.

In another example, when present in the polymer, the monomeric unit from group b and the monomeric unit from group d are present in the polymer at a molar ratio of from about 3:1 to 1:3 and/or from about 2:1 to 1:2 and/or from about 1.3:1 to 1:1.3 and/or about 1:1 or less.

In another example, when present in the polymer, the monomeric unit from group c and the monomeric unit from group d are present in the polymer at a molar ratio of from about 3:1 to 1:3 and/or from about 2:1 to 1:2 and/or from about 1.3:1 to 1:1.3 and/or about 1:1 or less.

In still another example, the polymer comprises a monomeric unit from group a and a monomeric unit from group c. For example, the polymer may comprise an acrylamide monomeric unit and a quaternary ammonium monomeric unit. The quaternary monomeric unit may be selected from the group consisting of: monoquaternary ammonium monomeric units, diquaternary ammonium monomeric units, and triquaternary ammonium monomeric units.

In one example, the polymer may comprise at least 70% wt of the monomeric unit from group a and no more than 30% wt of the monomeric unit from group c.

In still another example, the polymer comprises a monomeric unit from group a and a monomeric unit from group b. For example, the polymer may comprise an acrylamide monomeric unit and an acrylic acid monomeric unit.

In one example, the polymer may comprise at least 70% wt of the monomeric unit from group a and no more than 30% wt of the monomeric unit from group b.

In one example, the polymer may comprise at least 70% wt of the monomeric unit from group a and no more than 30% wt of the monomeric unit from group c.

In one example, the polymer may comprise at least 70% wt of the monomeric unit from group a and no more than 30% wt of the monomeric unit from group d.

In yet another example, the polymer comprises a monomeric unit from group b and a monomeric unit from group c. For example, the polymer may comprise an acrylic acid monomeric unit and a quaternary ammonium monomeric unit. The quaternary ammonium monomeric unit may be selected from the group consisting of: monoquaternary ammonium monomeric units, diquaternary ammonium monomeric units, and triquaternary ammonium monomeric units. In one example, the polymer may comprise no more than 25% wt of the monomeric unit from group b and no more than 75% wt of the monomeric unit from group c.

In even yet another example, the polymer comprises a monomeric unit from group a and a monomeric unit from group b and a monomer unit from group c. For example, the polymer may comprise an acrylamide monomeric unit, and an acrylic acid monomeric unit, and a quaternary ammonium monomeric unit. The quaternary ammonium monomeric unit may be selected from the group consisting of: monoquaternary ammonium monomeric units, diquaternary ammonium monomeric units, and triquaternary ammonium monomeric units. In one example, the polymer may comprise at least 70% wt of the monomeric unit from group a, less than 30% wt of the monomeric unit from group b and/or group c. In another example, the polymer may comprise at least 70% wt of the monomeric unit from group a, less than 30% wt of the monomeric unit from group b and/or group c and/or group d. In another example, the polymer may comprise from 70% to about 99% wt of the monomeric unit from group a, from 0.1% to about 10% wt of the monomeric unit from group b, and from 0.3% to about 29% wt of the monomeric unit from group c. In still another example, the polymer may comprise from 70% to about 99% wt of the monomeric unit from group a and from about 1% to 30% wt combined of the monomeric unit from group b and the monomeric unit from group c.

a. Nonionic Monomeric Units

The nonionic monomeric units may be selected from the group consisting of: nonionic hydrophilic monomeric units, nonionic hydrophobic monomeric units, and mixtures thereof.

Non-limiting examples of nonionic hydrophilic monomeric units suitable for the present invention include nonionic hydrophilic monomeric units derived from nonionic hydrophilic monomers selected from the group consisting of: hydroxyalkyl esters of α,β-ethylenically unsaturated acids, such as hydroxyethyl or hydroxypropyl acrylates and methacrylates, glyceryl monomethacrylate, α,β-ethylenically unsaturated amides such as acrylamide, N,N-dimethylmethacrylamide, N-methylolacrylamide, α,β-ethylenically unsaturated monomers bearing a water-soluble polyoxyalkylene segment of the poly(ethylene oxide) type, such as poly (ethylene oxide) α-methacrylates (Bisomer S20W, S10W, etc., from Laporte) or α,ω-dimethacrylates, Sipomer BEM from Rhodia (ω-behenyl polyoxyethylene methacrylate), Sipomer SEM-25 from Rhodia (ω-tristyrylphenyl polyoxyethylene methacrylate), α,β-ethylenically unsaturated monomers which are precursors of hydrophilic units or segments, such as vinyl acetate, which, once polymerized, can be hydrolyzed in order to give rise to vinyl alcohol units or polyvinyl alcohol segments, vinylpyrrolidones, α,β-ethylenically unsaturated monomers of the ureido type, and in particular 2-imidazolidinone-ethyl methacrylamide (Sipomer WAM II from Rhodia). In one example, the nonionic hydrophilic monomeric unit is derived from acrylamide.

Non-limiting examples of nonionic hydrophobic monomeric units suitable for the present invention include nonionic hydrophobic monomeric units derived from nonionic hydrophobic monomers selected from the group consisting of: vinylaromatic monomers such as styrene, alpha-methylstyrene, vinyltoluene, vinyl halides or vinylidene halides, such as vinyl chloride, vinylidene chloride, $C_1$-$C_{12}$ alkylesters of α,β-monoethylenically unsaturated acids such as methyl, ethyl or butyl acrylates and methacrylates, 2-ethylhexyl acrylate, vinyl esters or allyl esters of saturated carboxylic acids, such as vinyl or allyl acetates, propionates, versatates, stearates, α,β-monoethylenically unsaturated nitriles containing from 3 to 12 carbon atoms, such as acrylonitrile, methacrylonitrile, α-olefins such as ethylene, conjugated dienes, such as butadiene, isoprene, chloroprene.

b. Anionic Monomeric Units

Non-limiting examples of anionic monomeric units suitable for the present invention include anionic monomeric units derived from anionic monomers selected from the group consisting of: monomers having at least one carboxylic function, for instance α,β-ethylenically unsaturated carboxylic acids or the corresponding anhydrides, such as acrylic, methacrylic or maleic acids or anhydrides, fumaric acid, itaconic acid, N-methacroylalanine, N-acryloylglycine, and their water-soluble salts, monomers that are precursors of carboxylate functions, such as tert-butyl acrylate, which, after polymerization, give rise to carboxylic functions by hydrolysis, monomers having at least one sulfate or sulfonate function, such as 2-sulfooxyethyl methacrylate, vinylbenzene sulfonic acid, allyl sulfonic acid, 2-acrylamido-2-methylpropane sulfonic acid (AMPS), sulfoethyl acrylate or methacrylate, sulfopropyl acrylate or methacrylate, and their water-soluble salts, monomers having at least one phosphonate or phosphate function, such as vinylphosphonic acid, etc., the esters of ethylenically unsaturated phosphates, such as the phosphates derived from hydroxyethyl methacrylate (Empicryl 6835 from Rhodia) and those derived from polyoxyalkylene methacrylates, and their water-soluble salts, and 2-carboxyethyl acrylate (CEA). In one example, the anionic monomeric unit is derived from acrylic acid.

c. Cationic Monomeric Units

Non-limiting examples of cationic monomeric units suitable for the present invention include cationic monomeric units derived from cationic monomers selected from the group consisting of: N,N-(dialkylamino-ω-alkyl)amides of α,β-monoethylenically unsaturated carboxylic acids, such as N,N-dimethylaminomethylacrylamide or -methacrylamide, 2-(N,N-dimethylamino)ethylacrylamide or -methacrylamide, 3-(N,N-dimethylamino)propylacrylamide or -methacrylamide, and 4-(N,N-dimethylamino)butylacrylamide or -methacrylamide, α,β-monoethylenically unsaturated amino esters such as 2-(dimethylamino)ethyl acrylate (DMAA), 2-(dimethylamino)ethyl methacrylate (DMAM), 3-(dimethylamino)propyl methacrylate, 2-(tert-butylamino)ethyl methacrylate, 2-(dipentylamino)ethyl methacrylate, and 2-(diethylamino)ethyl methacrylate, vinylpyridines, vinylamine, vinylimidazolines, monomers that are precursors of amine functions such as N-vinylformamide, N-vinylacetamide, which give rise to primary amine functions by simple acid or base hydrolysis, acryloyl- or acryloyloxyammonium monomers such as trimethylammonium propyl methacrylate chloride, trimethylammonium ethylacrylamide or -methacrylamide chloride or bromide, trimethylammonium butylacrylamide or -methacrylamide methyl sulfate, trimethylammonium propylmethacrylamide methyl sulfate, (3-methacrylamidopropyl)trimethylammonium chloride (MAPTAC), (3-methacrylamidopropyl)trimethylammonium methyl sulphate (MAPTA-MES), (3-acrylamidopropyl)trimethylammonium chloride (APTAC), methacryloyloxyethyltrimethylammonium chloride or methyl sulfate, and acryloyloxyethyltrimethylammonium chloride; 1-ethyl-2-vinylpyridinium or 1-ethyl-4-vinylpyridinium bromide, chloride or methyl sulfate; N,N-dialkyldiallylamine monomers such as N,N-dimethyldiallylammonium chloride (DADMAC); polyquaternary monomers such as dimethylaminopropylmethacrylamide chloride and N-(3-chloro-2-hydroxypropyl)trimethylammonium (DIQUAT) and 2-hydroxy-$N^1$-(3-(2((3-methacrylamidopropyl) dimethylammino)-acetamido)propyl)-$N^1$,$N^1$,$N^3$,$N^3$,$N^3$-pentamethylpropane-1,3-diaminium chloride (TRIQUAT), and. In one example, the cationic monomeric unit comprises a quaternary ammonium monomeric unit, for example a monoquaternary ammonium monomeric unit, a diquaternary ammonium monomeric unit and a triquaternary monomeric unit. In one example, the cationic monomeric unit is derived from MAPTAC. In another example, the cationic monomeric unit is derived from DADMAC. In still another example, the cationic monomeric unit is derived from 2-hydroxy-$N^1$-(3-(2((3-methacrylamidopropyl)dimethylammino)-acetamido) propyl)-$N^1$,$N^1$,$N^3$,$N^3$,$N^3$-pentamethylpropane-1,3-diaminium chloride.

Dimethylaminoethyl(meth)acrylate, dimethylaminopropyl(meth)acrylate, di-tert-butylaminoethyl(meth)acrylate, dimethylaminomethyl(meth)acrylamide, dimethylaminopropyl(meth)acrylamide, ethylenimine, vinylamine, 2-vinylpyridine, 4-vinylpyridine and vinyl imidazole.

Trimethylammonium ethyl(meth)acrylate bromide, chloride or methyl sulfate, Trimethylammonium ethyl(meth) acrylate bromide, chloride or methyl sulfate, Trimethylammonium ethyl(meth)acrylate bromide, chloride or methyl sulfate, Dimethylaminoethyl(meth)acrylate benzyl chloride, 4-benzoylbenzyl dimethylammoniumethyl (meth)acrylate bromide, chloride or methyl sulfate, trimethylammonium ethyl(meth)acrylamido bromide, chloride, or methyl sulfate, trimethylammonium propyl(meth)acrylamido braomide, chloride, or methyl sulfate, vinyl benzyl trimethyl ammonium bromide, chloride or methyl sulfate, diallyldimethyl ammonium chloride, 1-ethyl-2-vinylpyridinium bromide, chloride or methyl sulfate, 4-vinylpyridinium bromide, chloride or methyl sulfate.

d. Zwitterionic Monomeric Units

Non-limiting examples of zwitterionic monomeric units suitable for the present invention include zwitterionic monomeric units derived from zwitterionic monomers selected from the group consisting of: sulfobetaine monomers, such as sulfopropyl dimethylammonium ethyl methacrylate (SPE from Raschig), sulfopropyldimethylammonium propylmethacrylamide (SPP from Raschig), and sulfopropyl-2-vinylpyridinium (SPV from Raschig), phosphobetaine monomers, such as phosphatoethyl trimethylammonium ethyl methacrylate, carboxybetaine monomers, N-(carboxymethyl)-3-methacrylamido-N,N-dimethlpropan-1-aminium chloride (CZ), 3-((3-methacrylamidopropyl)dimethylammonio)propane-1-sulfonate (SZ).

In one example, the polymer of the present invention comprises a nonionic hydrophilic monomeric unit. Non-limiting examples of suitable hydrophilic monomeric units are derived from nonionic hydrophilic monomers selected from the group consisting of: hydroxyalkyl esters of α,β-ethylenically unsaturated acids, α,β-ethylenically unsaturated amides, α,β-ethylenically unsaturated monoalkyl amides, α,β-ethylenically unsaturated dialkyl amides, α,β-ethylenically unsaturated monomers bearing a water-soluble polyoxyalkylene segment of the poly(ethylene oxide) type, α,β-ethylenically unsaturated monomers which are precursors of hydrophilic units or segments, vinylpyrrolidones, α,β-ethylenically unsaturated monomers of the ureido type, and mixtures thereof. In one example, the nonionic hydrophilic monomeric unit is derived from acrylamide.

In another example, the polymer of the present invention comprises a nonionic hydrophobic monomeric unit. Non-limiting examples of suitable nonionic hydrophobic monomeric units are derived from nonionic hydrophobic monomers selected from the group consisting of: vinylaromatic monomers, vinyl halides, vinylidene halides, $C_1$-$C_{12}$ alkylesters of α,β-monoethylenically unsaturated acids, vinyl esters of saturated carboxylic acids, allyl esters of saturated carboxylic acids, α,β-monoethylenically unsaturated nitriles containing from 3 to 12 carbon atoms, α-olefins, conjugated dienes, and mixtures thereof.

In one example, the polymer comprises an anionic monomeric unit. Non-limiting examples of suitable anionic monomeric units are derived from anionic monomers selected from the group consisting of: monomers having at least one carboxylic function, for instance α,β-ethylenically unsaturated carboxylic acids or the corresponding anhydrides, monomers that are precursors of carboxylate functions, monomers having at least one sulfate or sulfonate function, monomers having at least one phosphonate or phosphate function, esters of ethylenically unsaturated phosphates, and mixtures thereof. In one example, the anionic monomeric unit is derived from an anionic monomer selected from the group consisting of: acrylic acid, methacrylic acid, 2-acrylamido-2-methylpropane sulfonic acid, carboxyethyl acrylate, and mixtures thereof.

In one example, the polymer comprises a cationic monomeric unit. Non-limiting examples of suitable cationic monomeric units are derived from cationic monomers selected from the group consisting of: acryloyl- or acryloyloxyammonium monomers, 1-ethyl-2-vinylpyridinium or 1-ethyl-4-vinylpyridinium bromide, chloride or methyl sulfate, N,N-dialkyldiallylamine monomers, polyquaternary monomers, N,N-(dialkylamino-ω-alkyl)amides of α,β-monoethylenically unsaturated carboxylic acids, α,β-monoethylenically unsaturated amino esters, vinylpyridines, vinylamine, vinylimidazolines, monomers that are precursors of amine functions which give rise to primary amine functions by simple acid or base hydrolysis, and mixtures thereof. In one example, the cationic monomeric unit is derived from MAPTAC. In another example, the cationic monomeric unit is derived from DADMAC. In still another example, the cationic monomeric unit is derived from 2-hydroxy-$N^1$-(3-(2((3-methacrylamidopropyl)dimethylammino)-acetamido)propyl)-$N^1$,$N^1$,$N^3$,$N^3$,$N^3$-pentamethylpropane-1,3-diaminium chloride.

The polymer of the present invention may comprise an acrylamide-derived monomeric unit (group a) and a quaternary ammonium-derived monomeric unit (group c). The quaternary ammonium-derived monomeric unit may be selected from the group consisting of: monoquaternary ammonium-derived monomeric units, diquaternary ammonium-derived monomeric units, and triquaternary-derived ammonium monomeric units. In one example, the polymer comprises at least 70% wt of a monomeric unit from group a and no more than 30% wt of a monomeric unit from group c.

The polymer of the present invention may comprise an acrylamide-derived monomeric unit (group a) and an acrylic acid monomeric unit (group b). In one example, the polymer comprises at least 70% wt of a monomeric unit from group a and no more than 30% wt of a monomeric unit from group b. The polymer of the present invention may comprise an acrylamide-derived monomeric unit (group a) and a zwitterionic with both carboxylic acid and ammonium-derived monomeric unit (group d). In another example, the polymer may comprise an acrylamide-derived monomeric unit and a N-(carboxymethyl)-3-methacrylamido-N,N-dimethylpropan-1-aminium chloride-derived monomeric unit.

In another example, the polymer may comprise an acrylamide-derived monomeric unit (group a) and a zwitterionic with both sulfonate and ammonium-derived monomeric unit (group d). In another example, the polymer may comprise an acrylamide-derived monomeric unit and a 3-((3-methacrylamidopropyl)dimethylammonio)propane-1-sulfonate-derived monomeric unit.

In one example, the polymer comprises at least 70% wt of the monomeric unit from group a and no more than 30% wt of the monomeric unit from group b.

In one example, the polymer comprises at least 70% wt of the monomeric unit from group a and no more than 30% wt of the monomeric unit from group c.

In one example, the polymer comprises at least 70% wt of the monomeric unit from group a and no more than 30% wt of the monomeric unit from group d.

In one example, the polymer may comprise at least 70% wt of the monomeric unit from group a, less than 30% wt of the monomeric unit from group b and less than 30% wt of the monomeric unit from group c. In another example, the polymer may comprise from 70% to about 99% wt of the monomeric unit from group a, from 0.1% to about 10% wt of the monomeric unit from group b, and from 0.3% to about 25% wt of the monomeric unit from group c. In still another example, the polymer may comprise from 70% to about 99% wt of the monomeric unit from group a and from about 1% to 30% wt combined of the monomeric unit from group b and the monomeric unit from group c.

In still another example, the polymer of the present invention may comprise at least 70% wt of the monomeric unit from group a, less than 30% wt of the monomeric unit from group b and less than 30% wt of the monomeric unit from group d. In another example, the polymer may comprise from 70% to about 99% wt of the monomeric unit from group a, from 0.1% to about 10% wt of the monomeric unit from group b, and from 0.5% to about 29% wt of the monomeric unit from group d. In even still another example, the polymer may comprise from 70% to about 99% wt of the monomeric unit from group a and from about 1% to 30% wt combined of the monomeric unit from group b and the monomeric unit from group d.

In yet another example, the polymer may comprise at least 70% wt of the monomeric unit from group a, less than 30% wt of the monomeric unit from group c and less than 30% wt of the monomeric unit from group d. In still another example, the polymer may comprise from 70% to about 99% wt of the monomeric unit from group a, from 0.3% to about 10% wt of the monomeric unit from group b, and from 0.5% to about 29% wt of the monomeric unit from group d. In even still another example, the polymer may comprise from 70% to about 99% wt of the monomeric unit from group a and from about 1% to 30% wt combined of the monomeric unit from group c and the monomeric unit from group d.

In one example, the soil adsorbing agent (polymer) of the present invention is water soluble.

Soil

The soil adsorbed by the articles of manufacture of the present invention may include various consumer soils, such as household soils. Non-limiting examples of such as dust, pet dandruff, dirt including clay, vacuum cleaner soil, grime, greasy soils including dirt and films on mirrors and/or glass surfaces such as windows. The soil may also comprise allergens that may be associated with the consumer soils.

Process for Making Polymers

The polymers of the present invention may be made by any suitable process known in the art. For example, the polymer may be made by radical polymerization.

The polymers of the present invention can be made by a wide variety of techniques, including bulk, solution, emulsion, or suspension polymerization. Polymerization methods and techniques for polymerization are described generally in Encyclopedia of Polymer Science and Technology, Interscience Publishers (New York), Vol. 7, pp. 361-431 (1967), and Kirk-Othmer Encyclopedia of Chemical Technology, 3rd edition, Vol 18, pp. 740-744, John Wiley & Sons (New York), 1982, both incorporated by reference herein. See also Sorenson, W. P. and Campbell, T. W., Preparative Methods of Polymer Chemistry. 2nd edition, Interscience Publishers (New York), 1968, pp. 248-251, incorporated by reference herein, for general reaction techniques suitable for the present invention. In one example, the polymers are made by free radical copolymerization, using water soluble initiators. Suitable free radical initiators include, but are not limited to, thermal initiators, redox couples, and photochemical initiators. Redox and photochemical initiators are preferred for polymerization processes initiated at temperatures below about 30° C. (86° F.). Such initiators are described generally in Kirk-Othmer Encyclopedia of Chemical Technology, 3rd edition, John Wiley & Sons (New York), Vol. 13, pp. 355-373 (1981), incorporated by reference herein. Typical water soluble initiators that can provide radicals at 30° C. or below include redox couples, such as potassium persulfate/silver nitrate, and ascorbic acid/hydrogen peroxide. A preferred method utilizes thermal initiators in polymerization processes conducted above 40° C. (104° F.). Water soluble initiators that can provide radicals at 40° C. (104° F.) or higher can be used. These include, but are not limited to, hydrogen peroxide, ammonium persulfate, and 2,2'-azobis(2-amidinopropane)dihydrochloride. In one especially preferred method, water soluble starting monomers are polymerized in an aqueous alcohol solvent at 60° C. (140° F.) using 2,2'-azobis(2-amidinopropane)dihydrochloride as the initiator. The solvent should typically contain at least about 10% by volume, of alcohol in order to prevent the polymerization reaction medium from gelling. Suitable alcohols for use in such reaction include low molecular weight alcohols such as, but not limited to, methanol, ethanol, isopropanol, and butanol.

Another technique is a solution polymerization as described in U.S. Pat. No. 3,317,370, Kekish, issued May 2, 1967 and U.S. Pat. No. 3,410,828, Kekish, issued Nov. 12, 1968, both incorporated herein by reference. According to such process, the acrolein, or other aldehydic monomer, is copolymerized with a non-nucleophilic, water soluble, nitrogen-heterocyclic polymerizable monomer and a redox initiator system. The copolymer is then made cationic by reacting the copolymer with a water soluble amine or amine quaternary. Amines, including amine quaternaries, that are useful include, but are not limited to, primary, secondary, and tertiary amines such as ethylene diamine, diethylene triamine, triethylene tetramine, tetraethylene pentamine, or partial or fully quaternized derivatives of any of the foregoing, hydrazides and quaternaries thereof such as betaine hydrazide chloride, N—N-dimethylglycine hydrazide, unsymmetrical dimethyl hydrazides, polymers, such as those formed by reaction of urea and polyalkylene polyamines, guanidines, biguanides, guanylureas, mono and polyhydroxy polyamines and quaternaries thereof, etc. When using this emulsion copolymerization technique, it will be necessary to control molecular weight to within the ranges provided herein.

In one example, a method for making a polymer according to the present invention comprises the steps of:

i. providing two or more monomeric units selected from the group consisting of:
   a. nonionic monomeric units;
   b. anionic monomeric units;
   c. cationic monomeric units;
   d. zwitterionic monomeric units; and
   e. mixtures thereof; and ii. polymerizing the two or more monomeric units such that a polymer that exhibits a Soil Adsorption Value of at least 38 mg as measured according to the Soil Adsorption Test Method described herein is produced. In one example, the step of polymerizing comprises the step of mixing the two or more monomeric units or the monomers from which they are derived with water to form a monomer solution. The monomer solution may be deoxygenated. In addition, the monomer solution may be subjected (heated) to a temperature of at least 25° C., such as 60° C. The polymer may be subject to such temperature for a time sufficient to polymerize the monomeric units into a polymer, for example at least 10 minutes, and/or at least 18 hours depending on the reaction conditions. An initiator, such as a free-radical initiator, may be added to the monomer solution to polymerize the monomeric units (monomers) within the monomer solution to produce a polymer of the present invention. The levels of the various monomeric units (monomers) used to make the polymer may be any suitable level so long as a polymer according to the present invention is produced.

NON-LIMITING SYNTHESIS EXAMPLES

Sample Preparation

Initiator Solution Preparation 10 ml of water is added to a flask along with 1 gram of 2,2'-azobis(2-methylpropionamidine)dihydrochloride (available from Wako Chemicals), herein called V-50. This solution is sparged with argon gas to remove oxygen.

Monomer Preparation

Synthesis of 2-Hydroxy-$N^1$-(3-(2-((3-Methacrylamidopropyl)Dimethylammonio)Acetamido)Propyl)-$N^1$,$N^1$,$N^3$,$N^3$,$N^3$-Pentamethylpropane-1,3-Diaminium Chloride (TQ)

To a jacketed round bottom flask equipped with mechanical stirrer, gas inlet, condenser and thermometer is added 340.6 grams of dimethylamino propyl methacrylamide (DMAPMA, available from Sigma-Aldrich), 238.8 grams of methyl chloroacetate (available from Sigma-Aldrich), 0.5 g 4-methoxy phenol (available from Sigm-Aldrich), and 423 grams of methanol (available from Sigma-Aldrich). The round bottom flask is heated at 70° C. for 5 hours. This reaction is cooled to room temperature and then 0.5 grams of 4-methoxy phenol (available from Sigma-Aldrich) and 225 grams of dimethylaminoipropylamine (available from Sigma-Aldrich) is added evenly over a 2 hour period. After 2 hours the reaction is heated to 65° C. for 2 hours after which methanol is distilled out at 50° C. under vacuum. To this is added 690 grams of (3-chloro-2-hydroxypropyl)trimethylammonium chloride (available as a 60% aqueous solution from Sigma-Aldrich). The temperature is maintained at 65-70° C. for 2 hours. During these 2 hours methanol is stripped out and water is added to make a 55% solution in water based on weight. The reaction is continued in water at 65-70° C. for another hour to yield the TQ monomer.

Synthesis of 3-((3-Methacrylamidopropyl)Dimethylammonio)Propane-1-Sulfonate (SZ)

Into a round bottom flask is added 26.4 grams of anhydrous acetonitrile (available from Sigma-Aldrich) and 15.5 grams of propane sultone (available from Sigma-Aldrich), and this is stirred for 30 minutes. After the 30 minutes, a solution of 25.6 grams of DMAPMA in 56.5 grams of acetonitrile is added. The mixture is stirred and warmed to 35° C. A white precipitate quickly forms. Once the white precipitate takes up the bulk of the volume, the liquid is decanted. The solid is washed once with acetonitrile and again the liquid is removed by decanting. The solids are then washed in 2× volume diethyl ether. They are then filtered via funnel and washed with copious amounts (via filtration) of diethyl ether. The NMR structure is consistent with the structure of the target molecule SZ.

Synthesis of N-(Carboxymethyl)-3-Methacrylamido-N,N-Dimethylpropan-1-Aminium Chloride (CZ)

To a round bottom flask is added 16.5 grams of methyl bromoacetate (available from Sigma-Aldrich), 74 grams of tetrahydrofuran (THF, available from Sigma-Aldrich), and 16.5 grams of DMAPMA. The solution is stirred for 16 hours at 25° C., and then the stirring is discontinued. After settling, the top layer of THF is discarded. The lower layer is washed with 50 mL of hexanes (available from Sigma-Aldrich) twice and becomes a viscous material. The material is then dissolved in 15 mL of methanol (available from Sigma-Aldrich) and precipitated into 150 mL of diethyl ether (available from Sigma-Aldrich). The precipitate is washed several times with diethylether until it becomes a viscous semi-solid. It is then dried overnight under high vacuum at room temperature. A small portion is taken for NMR analysis. The remainder of the intermediate is placed in a glass desiccator containing calcium chloride until the next step.

3.3 grams of the intermediate from above is dissolved in 10 mL of deionized water and run through a column consisting of 50 mL of Dowex Marathon A hydroxide exchange resin (available from VWR Scientific) in a glass column of 2.5 cm diameter at 2.7 mL/min. The effluent is collected and 13 mL of 1N hydrochloric acid (available from Sigma-Aldrich) is added. The water is dried off under vacuum at room temperature. The sample is then dried overnight under high vacuum at room temperature. The material is removed from the vacuum and a small portion is taken for NMR analysis. 2.71 g of deionized water is added to the material to form the finished product CZ which is stored as a solution in water.

Polymer Preparation

Into a reaction vessel are added the monomers in the amounts listed for the examples in Table 5 below and 456 g of water. The monomers, acrylamide (herein called AAM), acrylic acid (herein called AA), diallyldimethylammonium chloride (herein called DADMAC), 2-carboxy ethyl acrylate (herein called CEA), 2-acrylamido-2-methylpropane sulfonic acid (herein called AMPS) and [3-(methyacryloylamino)propyl]trimethylammonium chloride (herein called MAPTAC), are all available from Sigma Aldrich. MAPTAC is used as a 50% w/w solution. TQ, SZ and CZ are used as prepared above. The reaction vessel is sparged with nitrogen to remove oxygen from the system and a nitrogen atmosphere is maintained in the vessel. The reaction vessel and contents are heated to a temperature of 60° C.

Once the contents have reached 60° C., the initiator solution 1 mL of the V-50 as prepared above is added as a 10% solution (except for Example 1.17 which used 0.0562 g of V-50 neat). The reaction is kept at 60° C. for 48 hours.

Mirapol HSC 300 was obtained from Rhodia S. A. (Paris, France).

Tables 5 through 7 list examples of monomers and levels from which monomeric units are derived that form non-limiting examples of polymers (soil adsorbing polymers) of the invention.

TABLE 5

Examples: Polymer Construction Data

| Ex. | AAM (g) | AA (g) | MAPTAC (g) | DADMAC (g) | TQ (g) | CEA (g) | AMPS (g) | SZ (g) | CZ (g) |
|---|---|---|---|---|---|---|---|---|---|
| 1.1 | 21.60 | 0.00 | 2.40 | 0.00 | 0.00 | 0.00 | 0.00 | 0.00 | 0.00 |
| 1.2 | 21.60 | 0.31 | 2.09 | 0.00 | 0.00 | 0.00 | 0.00 | 0.00 | 0.00 |
| 1.3 | 21.60 | 0.60 | 1.81 | 0.00 | 0.00 | 0.00 | 0.00 | 0.00 | 0.00 |
| 1.4 | 21.60 | 1.20 | 1.21 | 0.00 | 0.00 | 0.00 | 0.00 | 0.00 | 0.00 |
| 1.5 | 21.60 | 1.80 | 0.61 | 0.00 | 0.00 | 0.00 | 0.00 | 0.00 | 0.00 |
| 1.6 | 21.59 | 2.40 | 0.00 | 0.00 | 0.00 | 0.00 | 0.00 | 0.00 | 0.00 |
| 1.7 | 0.00 | 6.00 | 18.00 | 0.00 | 0.00 | 0.00 | 0.00 | 0.00 | 0.00 |
| 1.8 | 2.41 | 5.40 | 16.20 | 0.00 | 0.00 | 0.00 | 0.00 | 0.00 | 0.00 |
| 1.9 | 7.20 | 4.20 | 12.60 | 0.00 | 0.00 | 0.00 | 0.00 | 0.00 | 0.00 |
| 1.10 | 12.00 | 3.00 | 9.00 | 0.00 | 0.00 | 0.00 | 0.00 | 0.00 | 0.00 |
| 1.11 | 16.79 | 1.81 | 5.42 | 0.00 | 0.00 | 0.00 | 0.00 | 0.00 | 0.00 |
| 1.12 | 19.22 | 1.20 | 3.60 | 0.00 | 0.00 | 0.00 | 0.00 | 0.00 | 0.00 |
| 1.13 | 20.41 | 0.90 | 2.70 | 0.00 | 0.00 | 0.00 | 0.00 | 0.00 | 0.00 |
| 1.14 | 21.61 | 0.60 | 1.80 | 0.00 | 0.00 | 0.00 | 0.00 | 0.00 | 0.00 |
| 1.15 | 22.81 | 0.31 | 0.92 | 0.00 | 0.00 | 0.00 | 0.00 | 0.00 | 0.00 |
| 1.16 | 23.51 | 0.12 | 0.36 | 0.00 | 0.00 | 0.00 | 0.00 | 0.00 | 0.00 |
| 1.17 | 23.75 | 0.06 | 0.18 | 0.00 | 0.00 | 0.00 | 0.00 | 0.00 | 0.00 |
| 1.18 | 23.76 | 0.06 | 0.18 | 0.00 | 0.00 | 0.00 | 0.00 | 0.00 | 0.00 |
| 1.19 | 23.87 | 0.03 | 0.10 | 0.00 | 0.00 | 0.00 | 0.00 | 0.00 | 0.00 |
| 1.20 | 24.09 | 0.00 | 0.00 | 0.00 | 0.00 | 0.00 | 0.00 | 0.00 | 0.00 |

TABLE 5-continued

Examples: Polymer Construction Data

| Ex. | AAM (g) | AA (g) | MAPTAC (g) | DADMAC (g) | TQ (g) | CEA (g) | AMPS (g) | SZ (g) | CZ (g) |
|---|---|---|---|---|---|---|---|---|---|
| 1.21 | 23.76 | 0.07 | 0.00 | 0.17 | 0.00 | 0.00 | 0.00 | 0.00 | 0.00 |
| 1.22 | 23.77 | 0.0285 | 0.00 | 0.00 | 0.212 | 0.00 | 0.00 | 0.00 | 0.00 |
| 1.23 | 23.76 | 0.00 | 0.145 | 0.00 | 0.00 | 0.0939 | 0.00 | 0.00 | 0.00 |
| 1.24 | 23.76 | 0.00 | 0.13 | 0.00 | 0.00 | 0.00 | 0.12 | 0.00 | 0.00 |
| 1.25 | 23.77 | 0.00 | 0.00 | 0.00 | 0.00 | 0.00 | 0.00 | 0.252 | 0.00 |
| 1.26 | 23.76 | 0.00 | 0.00 | 0.00 | 0.00 | 0.00 | 0.00 | 0.00 | 0.240 |
| 1.27 | 23.52 | 0.00 | 0.00 | 0.00 | 0.00 | 0.00 | 0.00 | 0.00 | 0.479 |
| 1.28 | 23.76 | 0.00 | 0.003 | 0.00 | 0.00 | 0.00 | 0.00 | 0.00 | 0.240 |
| 1.29 | 23.76 | 0.002 | 0.00 | 0.00 | 0.00 | 0.00 | 0.00 | 0.00 | 0.240 |

TABLE 6

Examples: Polymer Solution Data

| Ex. | Mass Composition of Monomers | Solids (%) | Polymer Solution (g) | Polymer Solution + Water (g) | Conc. (%) |
|---|---|---|---|---|---|
| 2.1 | 90% AAM, 10% MAPTAC | 5.44 | 0.4253 | 115.68 | 0.02 |
| 2.2 | 90% AAM, 1.3% AA, 8.7% MAPTAC | 5.41 | 0.3927 | 106.24 | 0.02 |
| 2.3 | 90% AAM, 2.5% AA, 7.5% MAPTAC | 5.45 | 0.4013 | 109.34 | 0.02 |
| 2.4 | 90% AAM, 5% AA, 5% MAPTAC | 5.43 | 0.3974 | 107.89 | 0.02 |
| 2.5 | 90% AAM, 7.5% AA, 2.5% MAPTAC | 5.42 | 0.7522 | 203.84 | 0.02 |
| 2.6 | 90% AAM, 10% AA | 5.42 | 0.3985 | 108.00 | 0.02 |
| 2.7 | 25% AA, 75% MAPTAC | 5.25 | 0.3823 | 100.36 | 0.02 |
| 2.11 | 69.9% AAM, 7.5% AA, 22.6% MAPTAC | 5.30 | 0.3810 | 100.97 | 0.02 |
| 2.12 | 80% AAM, 5% AA, 15 % MAPTAC | 5.31 | 0.3899 | 103.53 | 0.02 |
| 2.13 | 85% AAM, 3.7% AA, 11.3 % MAPTAC | 5.30 | 0.4403 | 116.69 | 0.02 |
| 2.14 | 90% AAM, 2.5% AA, 7.5% MAPTAC | 5.26 | 0.3800 | 99.93 | 0.02 |
| 2.15 | 94.9% AAM, 1.3% AA, 3.8% MAPTAC | 5.34 | 0.3982 | 106.34 | 0.02 |
| 2.16 | 98% AAM, 0.5% AA, 1.5% MAPTAC | 2.54 | 0.7969 | 101.21 | 0.02 |
| 2.17 | 99% AAM, 0.25% AA, 0.75% MAPTAC | 2.56 | 0.7944 | 101.68 | 0.02 |
| 2.18 | 99% AAM, 0.25% AA, 0.75% MAPTAC | 5.32 | 0.3751 | 100.49 | 0.02 |
| 2.19 | 99.5% AAM, 0.125% AA, 0.375% MAPTAC | 2.57 | 0.7850 | 100.89 | 0.02 |
| 2.21 | 99% AAM, 0.3% AA, 0.7% DADMAC | 5.40 | 0.3876 | 104.70 | 0.02 |
| 2.22 | 99% AAM, 0.12% AA, 0.88% TQ | 5.16 | 3.8100 | 980.46 | 0.02 |
| 2.23 | 99.01% AAM, 0.39% CEA, 0.6% MAPTAC | 5.27 | 0.3914 | 103.13 | 0.02 |
| 2.24 | 99% AAM, 0.5% AMPS, 0.5% MAPTAC | 5.40 | 0.3823 | 103.22 | 0.02 |
| 2.25 | 98.95% AAM, 1.05% SZ | 5.29 | 0.3791 | 100.25 | 0.02 |
| 2.26 | 99% AAM, 1% CZ | 5.28 | 0.4004 | 105.73 | 0.02 |
| 2.27 | 98% AAM, 2% CZ | 5.13 | 0.4055 | 104.15 | 0.02 |
| 2.28 | 98.99% AAM, 0.01% MAPTAC, 1% CZ | 5.15 | 0.5177 | 133.36 | 0.02 |
| 2.29 | 98.99% AAM, 0.01% AA, 1% CZ | 5.14 | 0.5941 | 152.90 | 0.02 |

TABLE 7

| Ex. | Mass Composition of Monomers | $M_n$ | PDI |
|---|---|---|---|
| 3.1 | 90% AAM, 10% MAPTAC | 1,211,000 | 1.240 |
| 3.2 | 90% AAM, 1.3% AA, 8.7% MAPTAC | 948,200 | 1.239 |
| 3.3 | 90% AAM, 2.5% AA, 7.5% MAPTAC | 852,500 | 1.351 |
| 3.4 | 90% AAM, 5% AA, 5% MAPTAC | 753,500 | 1.402 |
| 3.5 | 90% AAM, 7.5% AA, 2.5% MAPTAC | 970,300 | 1.271 |
| 3.6 | 90% AAM, 10% AA | 1,021,000 | 1.222 |
| 3.7 | 25% AA, 75% MAPTAC | 201,500 | 1.823 |
| 3.11 | 69.9% AAM, 7.5% AA, 22.6% MAPTAC | — | — |
| 3.12 | 80% AAM, 5% AA, 15% MAPTAC | 821,000 | 1.269 |
| 3.13 | 85% AAM, 3.7% AA, 11.3% MAPTAC | 865,600 | 1.241 |
| 3.14 | 90% AAM, 2.5% AA, 7.5% MAPTAC | — | — |
| 3.15 | 94.9% AAM, 1.3% AA, 3.8% MAPTAC | 927,100 | 1.222 |
| 3.16 | 98% AAM, 0.5% AA, 1.5% MAPTAC | | |
| 3.17 | 99% AAM, 0.25% AA, 0.75% MAPTAC | 858,100 | 1.302 |
| 3.18 | 99% AAM, 0.25% AA, 0.75% MAPTAC | 814,200 | 1.293 |
| 3.19 | 99.5% AAM, 0.125% AA, 0.375% MAPTAC | 1,212,000 | 1.285 |
| 3.21 | 99% AAM, 0.3% AA, 0.7% DADMAC | 520,400 | 1.432 |
| 3.22 | 99% AAM, 0.12% AA, 0.88% TQ | 1,050,000 | 1.165 |
| 3.23 | 99.01% AAM, 0.39% CEA, 0.6% MAPTAC | 791,200 | 1.219 |
| 3.24 | 99% AAM, 0.5% AMPS, 0.5% MAPTAC | 644,400 | 1.579 |
| 3.25 | 98.95% AAM, 1.05% SZ | 542,800 | 1.566 |
| 3.26 | 99% AAM, 1% CZ | 862,700 | 1.269 |
| 3.27 | 98% AAM, 2% CZ | — | — |
| 3.28 | 98.99% AAM, 0.01% MAPTAC, 1% CZ | — | — |
| 3.29 | 98.99% AAM, 0.01% AA, 1% CZ | — | — |

Processes for Making Article of Manufacture

The article of manufacture of the present invention may be made by any suitable process known in the art. For example, if the article of manufacture is a web, any suitable web making process can be used.

In one example, the article of manufacture comprises a fibrous structure. The fibrous structure may be made by a process comprising the step of contacting a surface of the fibrous structure with a soil adsorbing agent according to the present invention. In another example, the fibrous structure may be made by a process comprising the step of adding a soil adsorbing agent according to the present invention to a fiber slurry that is used to produce the fibrous structure. We have surprisingly found that direct application of the high active content water in oil emulsion to the dry sheet can be accomplished without significantly disrupting the sheet structure and providing for improved VFS absorbent capacity in much the same way as superabsorbent polymers without the negative consumer response associated with release of visible super absorbent gel particles contaminating the surface being cleaned or the consumers hands.

In another example of a process for making an article of manufacture, such as a fibrous structure, comprises the steps of:

a. providing a fiber slurry;
b. depositing the fiber slurry onto a foraminous wire to form an embryonic web;
c. drying the embryonic web to produce a fibrous structure; and
d. contacting the fibrous structure with a soil adsorbing agent to produce an article of manufacture (a fibrous structure, for example a dry fibrous structure) in accordance with the present invention.

In yet another example of a process for making an article of manufacture, such as a fibrous structure, comprises the steps of:

a. providing a fiber slurry comprising a soil adsorbing agent;
b. depositing the fiber slurry onto a foraminous wire to form an embryonic web; and
c. drying the embryonic web to produce an article of manufacture (a fibrous structure, for example a dry fibrous structure) in accordance with the present invention; and
d. optionally, contacting the article of manufacture with a soil adsorbing agent.

The fiber slurry may comprise permanent and/or temporary wet strength agents such as Kymene® (permanent wet strength) and Hercobond® (temporary wet strength) both available from Ashland Inc.

In one example, the soil adsorbing agent may be added to a fibrous structure of the present invention during papermaking, between the Yankee dryer and the reel, and/or during converting by applying it to one or more surfaces of the fibrous structure. In one example, a single-ply paper towel comprises the soil adsorbing agent on one surface of the paper towel. In another example, a single-ply paper towel comprises the soil adsorbing agent on both surfaces of the paper towel. In still another example, a two-ply paper towel comprises the soil adsorbing agent on one or both exterior surfaces of the two-ply paper towel. In still another example, a two-ply paper towel comprises the soil adsorbing agent on one or more interior surfaces of the two-ply paper towel. In yet another example, a two-ply paper towel comprises the soil adsorbing agent on one or more exterior surfaces and one or more interior surfaces of the two-ply paper towel. One of ordinary skill would understand that exterior surfaces and various interior surfaces of a three or more ply paper towel could comprise the soil adsorbing agent.

In still another example, an emulsion, an inverse emulsion, of the soil adsorbing agent may be added to the fiber slurry in the wet-end addition of a papermaking process by adding the neat inverse emulsion as received or after inverting the emulsion by forming a dilute 0.1-0.2% active solids aqueous solution of the soil adsorbing agent into suction of fan pump of a paper machine.

In one example, the article of manufacture may be made by adding a soil adsorbing agent into the wet end of a wet laid papermaking process. In other words, the soil adsorbing agent may be added to a fiber slurry comprising hardwood and/or softwood fibers prior to depositing the slurry onto a foraminous wire.

In another example, the article of manufacture of the present invention may be made by printing a soil adsorbing agent onto a surface of an article of manufacture, such as a fibrous structure, for example in a converting operation. The printing operation may occur by any suitable printing equipment, for example by way of a gravure roll.

In still another example, an article of manufacture of the present invention may be made by extruding a soil adsorbing agent onto a surface of an article of manufacture, such as a fibrous structure.

In even another example, an article of manufacture of the present invention may be made by spraying a soil adsorbing agent onto a surface of an article of manufacture, such as a fibrous structure.

In yet another example, an article of manufacture of the present invention may be made by spraying a soil adsorbing agent onto a wet fibrous structure during papermaking after the vacuum dewatering step, but before the predryers and/or after the predryers, but before the Yankee.

In one example, one or more soil adsorbing agents may be added to a fibrous structure in the wet-end, in the fibers prior to inclusion into a fiber slurry, and/or during papermaking and/or during converting of the fibrous structure and/or to a finished fibrous structure, such as a paper towel. For example, a first soil adsorbing agent may be added to a fibrous structure in the wet-end and second soil adsorbing agent, the same or different as the first, may be added to the fibrous structure during papermaking and/or converting.

In even yet another example, an article of manufacture of the present invention may be made by depositing a plurality of fibers mixed with a soil adsorbing agent in an air-laid and/or coform process.

In still another example, an article of manufacture may be made that contains soil adsorbing agents by including the soil adsorbing agents at acceptable locations within spunbonding, meltblowing, carding, and/or hydroentangling processes.

The soil adsorbing agent may be applied to and/or included in an article of manufacture in a pattern, such as a non-random, repeating pattern.

Non-limiting Example

Articles of manufacture, in particular fibrous structures; namely, paper towels are produced utilizing a cellulose furnish consisting of a Northern Softwood Kraft (NSK) and Eucalyptus Hardwood (EUC) at a ratio of approximately 70/30. The NSK is refined as needed to maintain target wet burst at the reel. Any furnish preparation and refining methodology common to the papermaking industry can be utilized.

A 3% active solution Kymene 1142 is added to the refined NSK line prior to an in-line static mixer and 1% active solution of Advantage DF285, an ethoxylated fatty alcohol defoamer available from Ashland Inc. is added to the EUC furnish. The addition levels are 21 and 1 lbs active/ton of paper, respectively.

The NSK and EUC thick stocks are then blended into a single thick stock line followed by addition of 1% active carboxymethylcellulose (CMC) solution at 7 and 1 lbs active/ton of paper towel, and optionally, a softening agent may be added.

A Mirapol® HSC-300 stock solution available from Rhodia is prepared by dilution of the 20% active neat solution to 2% and neutralized to pH 4.5-5.0 with NaOH. The 2% active Mirapol® HSC-300 solution is blended into the thick stock after the CMC addition to achieve between 5 and 10 lbs active Mirapol® HSC-300/ton of paper towel. Immediately following the addition, the thick stock travels through an in-line Lightnin mixer.

The thick stock is then diluted with white water at the inlet of a fan pump to a consistency of about 0.15% based on total weight of NSK and EUC fiber. The diluted fiber slurry is directed to a non layered configuration headbox such that the wet web formed onto a Fourdrinier wire (foraminous wire).

Dewatering occurs through the Fourdrinier wire and is assisted by deflector and vacuum boxes. The Fourdrinier wire is of a 5-shed, satin weave configuration having 87 machine-direction and 76 cross-direction monofilaments per inch, respectively. The speed of the Fourdrinier wire is about 750 fpm (feet per minute).

The embryonic wet web is transferred from the Fourdrinier wire at a fiber consistency of about 24% at the point of transfer, to a patterned belt through-air-drying resin carrying fabric. To provide fibrous structure products of the present invention, the speed of the patterned through-air-drying fabric is approximately the same as the speed of the Fourdrinier wire. In another example, the embryonic wet web may be transferred to a patterned belt and/or fabric that is traveling slower, for example about 20% slower than the speed of the Fourdrinier wire (for example a wet molding process.

Further de-watering is accomplished by vacuum assisted drainage until the web has a fiber consistency of about 30%.

While remaining in contact with the patterned drying fabric, the web is pre-dried by air blow-through pre-dryers to a fiber consistency of about 65% by weight.

After the pre-dryers, the semi-dry web is transferred to a Yankee dryer and adhered to the surface of the Yankee dryer with a sprayed creping adhesive. The creping adhesive is an aqueous dispersion with the actives consisting of about 22% polyvinyl alcohol, about 11% CREPETROL® A3025, and about 67% CREPETROL® R6390. CREPETROL® A3025 and CREPETROL® R6390 are commercially available from Ashland Inc. (formerly Hercules Inc.). The creping adhesive is delivered to the Yankee surface at a rate of about 0.15% adhesive solids based on the dry weight of the web. The fiber consistency is increased to about 97% before the web is dry creped from the Yankee with a doctor blade.

The doctor blade has a bevel angle of about 25° and is positioned with respect to the Yankee dryer to provide an impact angle of about 81°. The Yankee dryer is operated at a temperature of about 177° C. and a speed of about 800 fpm. The fibrous structure is wound in a roll using a surface driven reel drum having a surface speed of about 656 feet per minute. In another example, the doctor blade may have a bevel angle of about 45° and is positioned with respect to the Yankee dryer to provide an impact angle of about 101° and the reel may be run at a speed that is about 15% faster than the speed of the Yankee.

The fibrous structure may be subsequently converted into a two-ply paper towel product having a basis weight of about 28-33 lbs/3000 $ft^2$.

The following non-limiting examples illustrate the inclusion of a soil adsorbing agent on and/or into the paper towel to provide a paper towel in accordance with the present invention.

Example 1

Paper Towel Comprising Hyperfloc®

A Hyperfloc® water-in-oil emulsion (about 30% active—about 30% polyacrylamide, 30% water, 30% high boiling oil, and 10% surfactants) available from HyChem, Inc. This Hyperfloc® emulsion is applied directly to a surface of a fibrous structure via a spray application in papermaking onto the fabric side and/or the wire side of the dry fibrous structure between the calender and the reel. The paper is then converted into a 2-ply finished product roll with the fabric side out or wire side out and/or one fabric side and one wire side out.

Example 2

Paper Towel Comprising Mirapol® HSC-300

Mirapol® HSC-300 available from Rhodia is applied directly to a surface of a fibrous structure via spray application in papermaking and/or converting of the fibrous structure.

In one example, the Mirapol® HSC-300 is applied directly to a fibrous structure via a spray application in papermaking onto the fabric side and/or the wire side of the dry fibrous structure between the calender and the reel. The paper is then converted into a 2-ply finished product roll with the fabric side out or wire side out and/or one fabric side and one wire side out.

In another example, the Mirapol® HSC-300 may be sprayed onto the wet fibrous structure during papermaking after the vacuum dewatering step and before the predryers and/or after the predryers, but before the Yankee.

In another example, the Mirapol® HSC-300 may be extruded, such as via slot extrusion, and/or printed, such as via gravure roll printing, onto a surface of the dry fibrous structure during a converting application of the fibrous structure between the Yankee and/or unwind reel and the winding of the finished fibrous structure into paper towel rolls.

Application of the Mirapol® HSC-300 to the fibrous structure during papermaking and/or converting may be applied to one or more surfaces of the fibrous structure. In one example, a single-ply paper towel comprises the Mirapol® HSC-300 on one surface of the paper towel. In another example, a single-ply paper towel comprises the Mirapol® HSC-300 on both surfaces of the paper towel. In still another example, a two-ply paper towel comprises Mirapol® HSC-300 on one or both exterior surfaces of the two-ply paper towel. In still another example, a two-ply paper towel comprises Mirapol® HSC-300 on one or more interior surfaces of the two-ply paper towel. In yet another example, a two-ply paper towel comprises Mirapol® HSC-300 on one or more exterior surfaces and one or more interior surfaces of the two-ply paper towel. One of ordinary skill would understand that exterior surfaces and various interior surfaces of a three or more ply paper towel could comprise the Mirapol® HSC-300.

In still another example, the Mirapol® HSC-300 may be added to the fiber slurry in the wet-end addition by adding the Mirapol® HSC-300 into the thick stock of any of the individual furnishes or the combined fiber mix or into the thin stock such as at the suction of fan pump.

Test Methods

Unless otherwise specified, all tests described herein including those described under the Definitions section and the following test methods are conducted on samples that have been conditioned in a conditioned room at a temperature of 73° F.±4° F. (about 23° C.±2.2° C.) and a relative humidity of 50%±10% for 2 hours prior to the test. All plastic and paper board packaging articles of manufacture must be carefully removed from the paper samples prior to testing. Discard any damaged product. Except where noted all tests are conducted in such conditioned room.

Determination of Percent Solids

An empty weigh pan (VWR disposable aluminum crinkle dishes with tabs, VWR Catalog #25433-010; or equivalent pan) is weighed to within ±0.1 mg ($Weight_{Pan}$). An aliquot of polymer solution as prepared above, 2.5±0.5 grams, is placed into the pan and weighed to within ±0.1 mg ($Weight_{Pan+Polymer\ Solution}$). The pan and the polymer solution are placed in an 80° C. ventilated oven, uncovered for 12 hours. After cooling to room temperature, the pan and the polymer solids are then weighed to within ±0.1 mg ($Weight_{Pan+Polymer\ Solid}$). The percent solids is calculated as follows:

$$PercentSolids(\%) = \left(\frac{Weight_{Pan+PolymerSolid} - Weight_{Pan}}{Weight_{Pan+PolymerSolution} - Weight_{Pan}}\right) * 100\%$$

Preparation of 0.02% Polymer Solution

Using the amounts listed in Table 2, the polymer solutions prepared above are diluted to 0.02% with deionized water. A receiving vessel large enough to hold the diluted solution is tared. The desired amount of the original polymer solution is added to the receiving vessel and the weight (of the solution only) recorded to within ±1 mg ($Weight_{Polymer\ Solution}$). The polymer solution is then diluted to 0.02% with deionized water and the weight recorded to within ±0.01 g ($Weight_{Polymer\ Solution+Water}$). The diluted solutions are capped and allowed to sit for 24 hours with occasional agitation prior to use to ensure polymer dissolution. The concentration is calculated as follows:

$$\text{Concentration}(\%) = \frac{Weight_{PolymerSolution} * PercentSolids}{Weight_{PolymerSolution+Water}}$$

Polymer Molecular Weight Determination

Polymer molecular mass is determined by GPC SEC/MALS. The HPLC is a Waters Alliance 2695 HPLC with an auto injector equipped with a bank of two linear μStyragel HT columns at room temperature. The flow rate is 1.0 mL/min and the mobile phase is dimethyl sulfoxide (DMSO) with 0.1% (weight/volume) LiBr. The detectors are Wyatt Dawn EOS Light scattering detector calibrated with toluene and normalized using 25K dextran in mobile phase and a Wyatt Optilab rEX refractive index detector at 30° C.

Samples for analysis are prepared at a known concentration in the range of 1 to 5 mg/mL. Samples are filtered using 0.2 μm polypropylene membrane filters. The injection volume is 100 μL. The data are collected and analyzed using ASTRA 5.3.4.14. Values for dn/dc are calculated from the RI trace assuming 100% mass recovery. Number average molecular weight and polydispersity index are calculated and reported.

Moisture Content Test Method

The moisture content present in an article of manufacture is measured using the following Moisture Content Test Method.

An article of manufacture or portion thereof ("sample") is placed in a conditioned room at a temperature of 73° F.±4° F. (about 23° C.±2.2° C.) and a relative humidity of 50%±10% for at least 24 hours prior to testing. The weight of the sample is recorded when no further weight change is detected for at least a 5 minute period. Record this weight as the "equilibrium weight" of the sample. Next, place the sample in a drying oven for 24 hours at 70° C. with a relative humidity of about 4% to dry the sample. After the 24 hours of drying, remove the sample from the drying oven and immediately weigh the sample Record this weight as the "dry weight" of the sample. The moisture content of the sample is calculated as follows:

$$\%\ \text{Moisture in sample} = 100\% \times \frac{(\text{Equilibrium weight of sample} - \text{Dry weight of sample})}{\text{Dry weight of sample}}$$

The % Moisture in sample for 3 replicates is averaged to give the reported % Moisture in sample.

Basis Weight Test Method

Basis weight of an article of manufacture, for example a finished fibrous structure and/or sanitary tissue product (referred to hereinafter for this test as "sample"), is measured by obtaining 12 sheets of the sample. The sheets of the sample are at greater than 3.5 in×3.5 in and may be delineated and connected to adjacent sheets by perforation or tear lines or the sheets of the sample may be individual sheets, such as in the form of individual wipes, napkins, and/or facial tissues. Make 2 stacks of 6 sheets each. If the 12 sheets are connected by perforation or tear lines, then separate the 12 sheets into 2-6 sheet long samples. Any perforations must be aligned on the same side when stacking the sheets. A precision cutter is used to cut each stack of sheets into exactly 8.89 cm×8.89 cm (3.500 in.×3.500 in.) squares from the center of each stack. The 2 stacks of cut squares are combined to make a basis weight pad of 12 squares thick. The basis weight pad is then weighed on a top loading balance with a minimum resolution of 0.01 g. The top loading balance must be protected from air drafts and other disturbances using a draft shield. Weights are recorded when the readings on the top loading balance become constant. The Basis Weight is calculated as follows:

$$\text{Basis Weight (lbs/3000 ft}^2) = \frac{\text{Weight of basis weight pad (g)} \times 3000\ \text{ft}^2}{453.6\ \text{g/lbs} \times 12\ \text{(cut squares)} \times [12.25\ \text{in}^2\ \text{(Area of basis weight pad)}/144\ \text{in}^2]}$$

$$\text{Basis Weight (g/m}^2) = \frac{\text{Weight of basis weight pad (g)} \times 10{,}000\ \text{cm}^2/\text{m}^2}{79.0321\ \text{cm}^2\ \text{(Area of basis weight pad)} \times 12\ \text{(cut squares)}}$$

Wet Caliper Test Method

The Wet Caliper is determined by cutting a sample from the center of an article of manufacture, such as a finished fibrous structure and/or sanitary tissue product sheet, if the article of manufacture has a relatively uniform basis weight, such that the sample is larger in size than a load foot loading surface where the load foot loading surface has a circular surface area of about 3.14 $in^2$. If the article of manufacture comprises a low basis weight region and a high basis weight region, then cutting a sample from the article of manufacture to maximize the low basis weight region portion of the sample such that the sample is larger in size than a load foot loading surface where the load foot loading surface has a circular surface area of about 3.14 $in^2$.

The sample is then wetted by submerging the sample in a distilled water bath for 30 seconds. The caliper of the wet sample is measured within 30 seconds of removing the sample from the bath. The sample is then confined between a horizontal flat surface and the load foot loading surface. The load foot loading surface applies a confining pressure to the sample of 14.7 g/cm$^2$ (about 0.21 psi). The load is applied gently to the substrate and the caliper is the resulting gap between the flat surface and the load foot loading surface taken after 5 seconds. Such measurements can be obtained on a VIR Electronic Thickness Tester Model II available from Thwing-Albert Instrument Company, Philadelphia, Pa. or equivalent instrument. The caliper measurement is repeated and recorded at least five (5) times using a fresh sample of the article of manufacture each time and an average wet caliper is calculated. The result is reported to within ±1 micron.

Vertical Full Sheet (VFS) Test Method

The Vertical Full Sheet (VFS) test method determines the amount of distilled water absorbed and retained by a fibrous structure of the present invention. This method is performed by first weighing a sample of the fibrous structure to be tested (referred to herein as the "dry weight of the sample"), then thoroughly wetting the sample, draining the wetted sample in a vertical position and then reweighing (referred to herein as "wet weight of the sample"). The absorptive capacity of the sample is then computed as the amount of water retained in units of grams of water absorbed by the sample. When evaluating different fibrous structure samples, the same size of fibrous structure is used for all samples tested.

The apparatus for determining the VFS capacity of fibrous structures comprises the following:

1) An electronic balance with a sensitivity of at least ±0.01 grams and a minimum capacity of 1200 grams. The balance should be positioned on a balance table and slab to minimize the vibration effects of floor/benchtop weighing. The balance should also have a special balance pan to be able to handle the size of the sample tested (i.e.; a fibrous structure sample of about 11 in. by 11 in.). The balance pan can be made out of a variety of articles of manufacture. Plexiglass is a common article of manufacture used.

Figures 6, 6A:
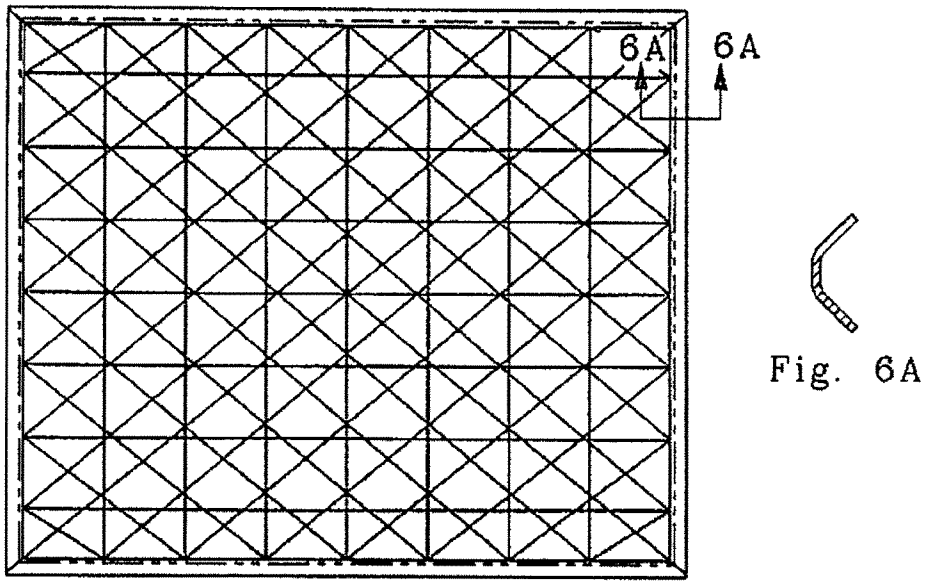
FIGS. 6 and 6A are diagrams of a support rack utilized in the VFS Test Method described herein.
Figure 7A:
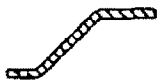
FIGS. 7 and 7A are diagrams of a support rack cover utilized in the VFS Test Method described herein.
Figure 7:
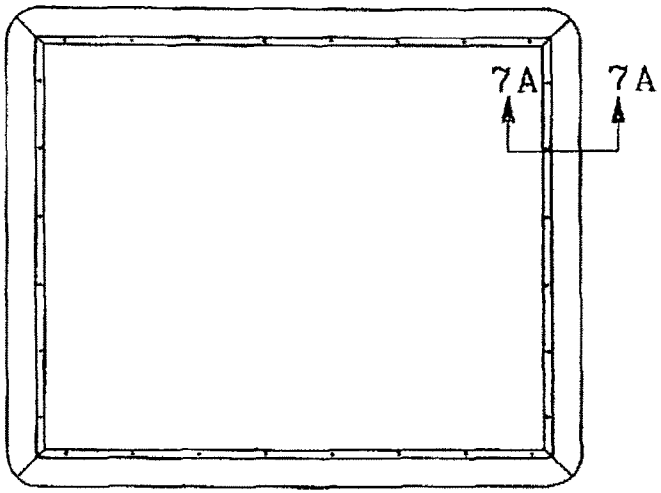

2) A sample support rack (FIGS. 6 and 6A) and sample support rack cover (FIGS. 7 and 7A) is also required. Both the rack and cover are comprised of a lightweight metal frame, strung with 0.012 in. diameter monofilament so as to form a grid as shown in FIG. 6. The size of the support rack and cover is such that the sample size can be conveniently placed between the two.

The VFS test is performed in an environment maintained at 23±1° C. and 50±2% relative humidity. A water reservoir or tub is filled with distilled water at 23±1° C. to a depth of 3 inches.

Eight 7.5 inch×7.5 inch to 11 inch×11 inch samples of a fibrous structure to be tested are carefully weighed on the balance to the nearest 0.01 grams. The dry weight of each sample is reported to the nearest 0.01 grams. The empty sample support rack is placed on the balance with the special balance pan described above. The balance is then zeroed (tared). One sample is carefully placed on the sample support rack. The support rack cover is placed on top of the support rack. The sample (now sandwiched between the rack and cover) is submerged in the water reservoir. After the sample is submerged for 60 seconds, the sample support rack and cover are gently raised out of the reservoir.

The sample, support rack and cover are allowed to drain vertically (at angle greater than 60° but less than 90° from horizontal) for 60±5 seconds, taking care not to excessively shake or vibrate the sample. While the sample is draining, the rack cover is removed and excess water is wiped from the support rack. The wet sample and the support rack are weighed on the previously tared balance. The weight is recorded to the nearest 0.01 g. This is the wet weight of the sample.

The procedure is repeated for with another sample of the fibrous structure, however, the sample is positioned on the support rack such that the sample is rotated 90° in plane compared to the position of the first sample on the support rack.

The gram per fibrous structure sample absorptive capacity of the sample is defined as (wet weight of the sample—dry weight of the sample). The calculated VFS is the average of the absorptive capacities of the two samples of the fibrous structure.

Soil Adsorption Test Method

In order to measure an article of manufacture's average Soil Adsorption value the following test is conducted.

Preparation:

A specimen of the article of manufacture to be tested is obtained from the central portion of a representative sample of the article of manufacture. The specimen is prepared by cutting a CD strip (extending across the entire CD of the article of manufacture) from an article of manufacture, such as a finished fibrous structure and/or sanitary tissue product sheet (sample) such that the cut CD strip specimen has a length and width resulting in the specimen weighing 0.65 g±0.02 g. The sheet of the sample from which the CD strip specimen is cut may be delineated and connected to adjacent sheets by perforation or tear lines or the sheets of the sample may be individual sheets, such as in the form of individual wipes and/or facial tissues. If connected via perforation or tear lines, then separate one sheet from any adjacent sheet before cutting the CD strip from the sheet. The CD strip specimen needs to be free of perforations and is obtained from a portion of an article of manufacture at least 0.5 inches from any perforations. The specimen is conditioned as described above. The sample weight ($W_{Prod}$) is recorded to the within ±0.0001 g. A suitable ball-point pen or equivalent marker is used to write the specimen name onto a corner of the specimen.

A centrifuge tube (VWR brand 50 mL superclear ultra high performance freestanding centrifuge tube with flat caps, VWR Catalog #82018-052; or equivalent tube) is labeled with the specimen name and weighed to within ±0.1 mg $W_{CT}$. Next, 155.0 mg±5.0 mg of a model soil (black todd clay) available from Empirical Manufacturing Co., 7616 Reinhold Drive, Cincinnati, Ohio 45237-3208) is placed into the centrifuge tube. The tube is re-weighed $W_{(CT+Soil)}$ and the model soil weight ($W_{soil}$) is determined to nearest 0.2 mg by difference $W_{(CT+Soil)}-W_{CT}$.

Distilled water, 35 g±0.5 g is added slowly to the centrifuge tube using a suitable dispenser. The centrifuge tube is a VWR brand 50 mL superclear ultra high performance freestanding centrifuge tube with flat caps (VWR Catalog #82018-052, or equivalent tube). The distilled water is poured carefully into the centrifuge tube to avoid causing a plume of dust from the model soil. If a plume of dust occurs such that the weight of soil in the tube may be impacted, the tube is discarded and a new tube is prepared. The tube is then re-weighed $W_{(CT+Soil+Water)}$ and the total weight ($W_{(Soil\ Dispersion)}$ of water plus soil in the centrifuge tube is calculated by subtracting the weight of the centrifuge tube $W_{CT}$ from the $W_{(CT+Soil+Water)}$ and recorded to the nearest 0.2 mg.

A glass petri dish (e.g. VWR 50×35, VWR Catalog #89000-280, or equivalent dish) is labeled and weighed to within 0.1 mg ($W_{(Petri\ Dish)}$).

Testing:

A reciprocating shaker is used to disperse the model soil in the water. The model soil must be completely dispersed for the results to be valid. A reciprocating shaker (IKA Works HS 501 digital reciprocating shaker, number 2527001, with a Universal attachment, number 8000200, or equivalent shaker) is set to 300±3 cycles per minute. The capped centrifuge tube containing the model soil and water is mounted in the shaker and shaken for 30 seconds to obtain a uniform dispersion of the soil in the water (soil dispersion).

The specimen is loosely folded along its transverse centerline with an accordion style (paper fan) folding technique. The specimen is loosely folded 5 times, to produce a sample that contains 10 segments each about 2.5 cm in length. This folding technique keeps the sample from being too tightly folded, which may hinder the efficiency of the paper to adsorb the soil. The folded sample is fully immersed into the soil dispersion in the centrifuge tube so that the folds run parallel to the length of the centrifuge tube. The tube is immediately re-capped and shaken in the reciprocating shaker for 30+/−1 seconds with the length axis of the centrifuge tube parallel to the motion of the reciprocating shaker.

After shaking, the folded specimen is carefully removed over the glass petri dish using laboratory tweezers. Care must be taken to ensure that greater than 95% of the soil dispersion is kept either in the original centrifuge tube or corresponding glass petri dish. The soil dispersion is wrung from the specimen using a "wringing" motion and collected in the glass petri dish. Once the soil dispersion has been removed from the specimen, the specimen is discarded. The remaining soil dispersion is poured from the centrifuge tube into the glass petri dish after swirling the mixture to re-disperse model soil into water, thereby ensuring that no model soil is inadvertently left behind in the centrifuge tube. The glass petri dish containing the model soil/water mixture is weighed to within ±0.1 mg $W_{(Petri\ Dish+Soil\ Dispersion)}$. The weight of soil dispersion recovered $W_{(Recovered\ Soil\ Dispersion)}$ is calculated by subtracting the weight of the glass petri dish $W_{(Petri\ Dish)}$ from the $W_{(Petri\ Dish+Soil\ Dispersion)}$. The glass petri dish is then placed into a vented laboratory drying oven at 105° C. until the sample is dry. The $W_{(Recovered\ Soil\ Dispersion)}$ should be >95% of the $W_{(Soil\ Dispersion)}$.

Once the sample is dry, the glass petri dish containing the dried model soil is removed from the oven and placed in a desiccator until cool and then re-weighed to within ±0.1 mg $W_{(Petri\ Dish+Residual\ Dry\ Soil)}$. The weight of residual soil $W_{(Residual\ Soil)}$ is calculated by subtracting the weight of the glass petri dish $W_{(Petri\ Dish)}$ from $W_{(Petri\ Dish+Residual\ Dry\ Soil)}$ and recorded to the nearest 0.2 mg.

Calculations:

To calculate the amount of residual model soil $W_{(Residual\ Soil)}$ left in the glass petri dish, the following equation is used:

$$W_{(Residual\ Soil)}=W_{(Petri\ Dish+Residual\ Dry\ Soil)}-W_{(Petri\ Dish)}$$

Residual model soil weight ($W_{(Residual\ Soil)}$) is reported in mg.

To calculate the amount of normalized residual model soil ($W_{(Norm\ Residual\ Soil)}$) left in the glass petri dish, the following equation is used:

$$W_{(Norm\ Residual\ Soil)}=W_{(Residual\ Soil)}*W_{(Soil\ Dispersion)}/W_{(Recovered\ Soil\ Dispersion)}$$

Normalized residual soil weight $W_{(Norm\ Residual\ Soil)}$ is reported in mg.

To calculate the amount of soil adsorbed by the sample, the following calculation is used:

$$W_{(Soil\ Adsorbed)}=(W_{(Soil)}-W_{(Norm\ Residual\ Soil)})/W_{(Prod)}$$

Soil adsorbed in sample $W_{(Soil\ Adsorbed)}$ is reported as mg soil/g article of manufacture.

The test is performed on three replicates and an average Soil Adsorption Value (Avg $W_{(Soil\ Adsorbed)}$) is calculated for the article of manufacture.

Mirror Cleaning Test Method

A test stand cart holding 4 individual 28"×28" mirrors (one on each of the 4 sides) resting on a flat surface, such as a floor, is utilized for the mirror cleaning test. The silver mirror layer is on the back surface of a flat clear glass sheet approximately 5 mm thick. The cart is configured such that the bottom edge of each mirror is approximately 3' 6" off the flat surface. A handheld light is utilized to aid in visualization of streaks. Best results are achieved by moving the hand held light along the surface of the mirror while viewing from the side as opposed to looking perpendicular to the surface of the mirror.

The mirror is prepared for testing by cleaning as follows: 1) Windex® commercially available from SC Johnson (a composition containing 0.1-1.0% by weight of Ethyleneglycol Monohexylether, 1.0-5.0% by weight of Isopropanol, and 90-100% by weight of Water) or equivalent is sprayed (4 full sprays, about 3.5 g of solution) onto the mirror surface which is then spread across the entire surface of the mirror with 2 sheets of a 1-ply paper towel, for example 2010 commercially available Bounty® Basic (folded into quarters) using a circular wiping motion; 2) the mirror surface is then wiped dry and lightly polished with the essentially dry side of the folded 1-ply paper towel; 3) wiping the mirror surface with an additional two sheets of the 1-ply paper towel saturated with deionized water; and 4) using a squeegee in a top to bottom motion to remove all excess deionized water. Steps 3) & 4) may be repeated as necessary to achieve a streak and smudge free mirror surface that has no residual impact on the cleaning performance of subsequent test articles of manufacture. Any suitable absorbent substrate can be used in place of Bounty Basic that is not impregnated with polymers that may be deposited onto the glass surface, which may impact the ease or difficulty of cleaning with subsequent test article of manufacture.

A model soil suspension is prepared by suspending 1% by weight of Black Todd Clay in a 50/50 weight ratio of water/isopropyl alcohol mixture containing 0.05% by weight of 100% soybean oil (viscosity of from 150 cP to 200 cP).

Preparation of 100% cooked soybean oil is as follows. Approximately 200 grams of 100% soybean oil available from Spectrum Chemical Manufacturing Corp., 14422 S. San Pedro St., Gardena, Calif. 90248 is placed in a 1000 mL beaker with stir bar. The soybean oil in the beaker is placed on a hot plate and heated to 204° C. while stirring slowly. Air is added through a glass pipette tip set to bubble continuously through the oil. The oil is cooked continuously until viscosity, at 25° C.±2.2° C., is between 150 and 200 cP. The color changes to a dark orange. Viscosity is measured using a Cannon-Ubbelohde Viscometer tube #350 available from Cannon Instrument Company, State College, Pa. 16803, or equivalent viscometer. A sample of oil which is near room temperature is added to the viscometer and equilibrated to 25° C. in a constant temperature water bath. The efflux time for the meniscus to pass from the top mark to the bottom mark is measured to within ±0.01 second while allowing the oil to flow through the viscometer tube under gravity. Kinematic viscosity in $mm^2/s$ is calculated by multiplying the time in seconds by the calibration constant supplied with the viscometer tube. Separately the fluid density is determined by measuring the weight of a fixed volume of oil using a 25 mL volumetric flask and a 4 place analytical balance. Viscosity in cP can be calculated by multiplying the Kinematic viscosity by density of oil in g/mL. The cooking time will vary depending on quantity, surface area and air flow through the oil.

The following procedure is used to apply model soil to the clean mirror surfaces. The target amount of model soil sprayed is 44 g+/−2.5 g. A spray bottle, part #0245-01 available from www.SKS-bottle.com or equivalent spray bottle is used to spray the model soil suspension onto the mirror surface. Fill the spray bottle with the model soil suspension and weigh to the nearest 0.01 g and record as initial weight. The spray bottle is then manually pressurized as needed to achieve a dispersed spray of fine droplets. Additional pressurization is required between each mirror. Holding the spray bottle about 1.5 feet from the mirror surface a substantially horizontal sweeping motion is used starting at the top of the mirror surface and working down to the bottom of the mirror surface traversing the mirror surface a total of 8 times while attempting to have relatively even coverage on the mirror surface. After applying the model soil suspension to all 4 mirrors, the spray bottle and remaining contents are weighed to the nearest 0.01 g and recorded as weight after first spray. The mirrors are dried sequentially using a handheld hair dryer. The difference between the initial weight and after first spray is used to adjust the amount of spray applied in a second application to achieve the target amount of 44 g+/−2.5 g. The second application of the model soil suspension is applied to each mirror surface in a circular motion, moving from the outside (approximately 8-10 inches from the side edges) inward toward the center. After drying the second application of model soil suspension the mirrors are ready to be cleaned with an article of manufacture ("specimen") to be tested. If the time between soil application and cleaning of the mirrors with a test sample extends past 30 minutes, the mirrors need to be returned to their pristine condition using the procedure define previously after which the soil application procedure can be repeated.

Figure 2:
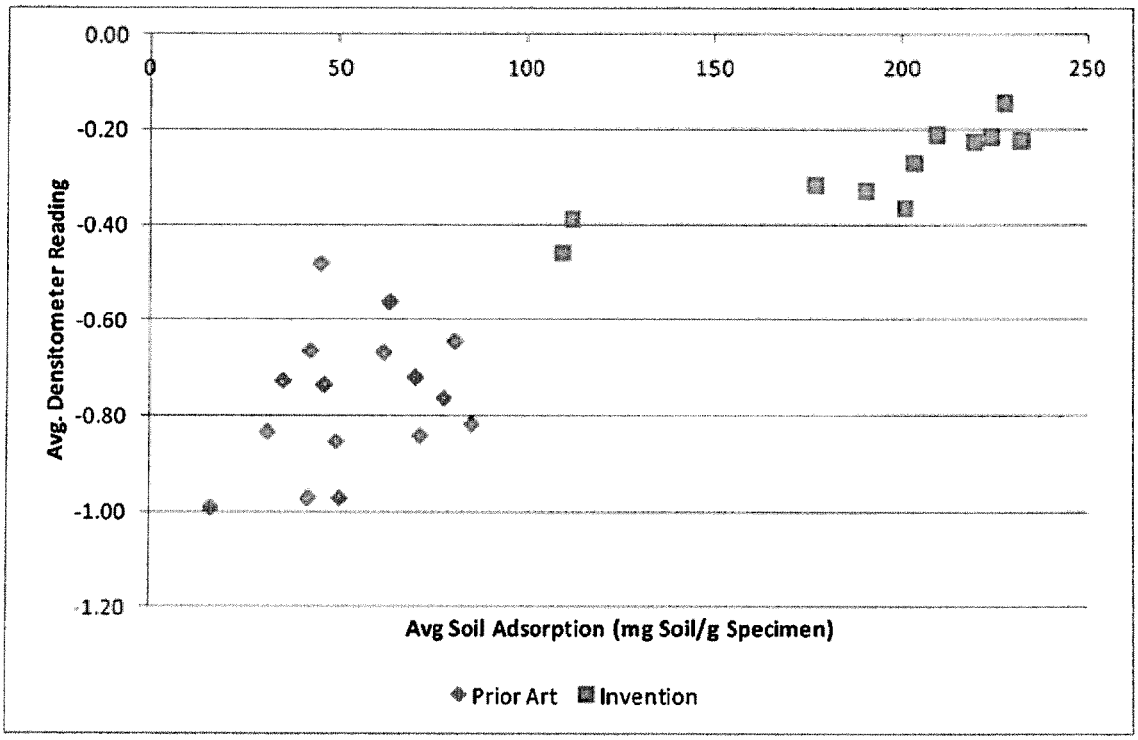
FIG. 2 is a graph showing average Mirror Cleaning Densitometer Values and average Soil Adsorption Values of articles of manufacture according to the present invention and prior art articles of manufacture.
Figure 3:
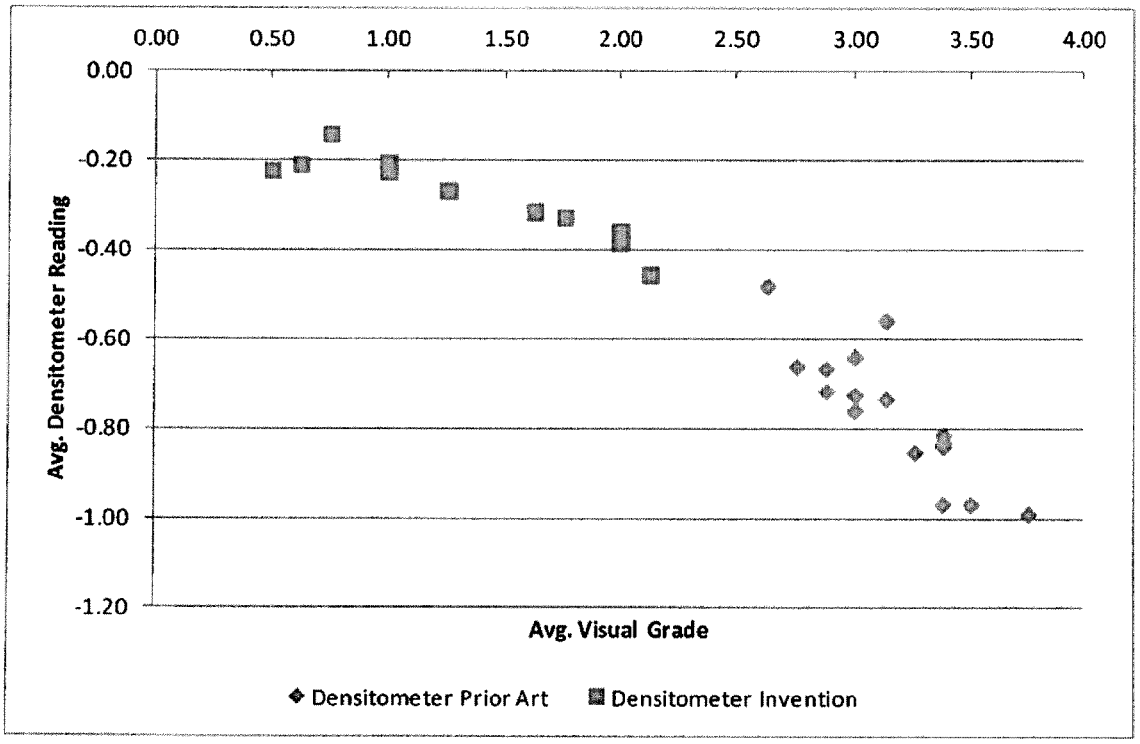
FIG. 3 is a graph showing the correlation between average Mirror Cleaning Visual Grade Values and average Mirror Cleaning Densitometer Values.

A specimen of a test article of manufacture, for example a paper towel, is prepared as follows. Two sheets of the article of manufacture, for example a paper towel, may be delineated and connected to adjacent sheets by perforation or tear lines or the sheets of the sample may be individual sheets, such as in the form of individual wipes, napkins, and/or facial tissues. If the article of manufacture, for example a paper towel, is a select-a-size format, then 4 sheets are used. Individual sheet dimensions or in the case of select-a-size two sheets vary by brand from about 8.5"×11" to 14"×11" and 2.20 g to 5.2 g. The 2 or for select-a-size 4 sheet specimen is folded in half as shown in FIG. 4 (along perforations if present) with the emboss side out (where applicable). As shown in FIG. 4, the folded sample is then folded in half again with the crease perpendicular to the MD direction and then folded in half again perpendicular to the CD direction such that a sample pad of quarter size sheet that is 8 sheets thick is formed, each sheet may consist of 1, 2 or more individual plies. The mirror surface is then treated with 5 full sprays of Windex: two at top; one in the center and two in the lower area of the mirror. The weight of Windex sprayed per mirror is about 4.35 g±0.36 g. The mirror surface is cleaned by grasping the sample pad in the hand, clamping the substrate between the thumb and index finger and wiping with firm pressure in a cross direction, while holding the sheet (side 1) as flat as possible upon the surface of the mirror and avoiding contacting the mirror with any part of the hand using 8 side-to-side passes, such that the full surface of the mirror is contacted. The sample pad is then turned over and the relatively dry back-side (side 2) is used to wipe the mirror surface in an up and down motion, with firm pressure applied using 14 passes, ensuring that the entire surface of the mirror is contacted, again holding the sample pad as flat against the mirror surface as possible. The sample pad is then unfolded once and then folded back on itself revealing a relatively fresh sample pad surfaces to clean the second mirror after application of Windex as discussed above; side 3 (opposite side 1) is used for the side-to-side wiping and then turned over to side 4 (opposite side 2) for the up and down wiping. The pad is then unfolded twice to reveal a fresh surface of the specimen. The specimen is then folded in half such that the fresh sample surface is visible with the two used areas of the first sample pad configuration (sides 1 and 3) facing each other and then folded again to clean the third mirror surface after application of Windex as discussed above. Side 5 opposite side 1 and 3 is used first and then turned over to side 6 for the second up and down wiping. The sample pad is unfolded once and then folded back on itself revealing sides 7 and 8 to clean the fourth mirror surface after application of Windex as discussed above. Side 7 opposite sides 5, 3 & 1 is used for the side-to-side wiping and then turned over to side 8 for the final up and down wiping. In each case the wettest part of the folded sample pad is used for the side-to-side wiping and the dryer side for the final up and down wiping; see FIG. 2 for an overview of the uses of the various portions of the sample of article of manufacture.

All 4 mirror surfaces should be cleaned sequentially such that minimal drying of the specimen pad occurs. After cleaning all four mirror surfaces, the mirror surface is permitted to dry and each mirror surface is visually graded for streaks on a 0 to 4 scale with aid of a handheld light. The qualitative grading scale is described below:

"0" represents streak/smudge free mirror surface;

"1" represents mirror surface with a few very light streaks.

"2" represents mirror surface with light or moderately visible streaks on nearly every up and down wipe.

"3" representing mirror surface that has moderate to heavy streaks where the streaks are starting to run together.

"4" represents mirror surface that has heavy streaks on every up and down pass and has a relatively continuous hazy appearance.

Half units e.g. 1.5 etc can be used as deemed necessary to most accurately describe the visual appearance of the mirrors enabling one to differentiate between heavy or light streaks and hazy appearance. The 4 individual grades are reported separately; averaged to report an average Mirror Cleaning Visual Grade Value; and summed to report a total Mirror Cleaning Visual Grade Value for the article of manufacture.

In addition to the visual grading scale, a measurement of optical density utilizing an X-Rite 518 Spectrodensitometer to differentiate cleaning performance of sample specimens is used. A full calibration as described in the operators manual is performed. The instrument is set-up per instructions in the manual in Density minus Reference Measurement Mode. The four 28"×28" mirror surfaces were cleaned as described above representing a pristine condition. A single reading of a mirror in pristine condition is completed and stored as Ref1 and is used as a reference for all subsequent measurements. A series of 9 measurements are made on each of the 4 mirrors (3 across the top, 3 across the middle and 3 across the bottom always maintaining a minimum of 3 inches from any edge of the mirror) as shown in FIG. 5. The mirror cleaning test stand is oriented in the lab such that there is no direct overhead lighting and rotated such that the mirror being measured is facing towards an interior wall thus minimizing any influence caused by external lighting differences. Measurements were performed on the each of the pristine mirrors. These 9 individual values are averaged for each mirror. The average values were found to be consistent between mirrors, however, as expected the average shows a small difference from the single point reference. This difference is used to correct all subsequent average values measured. Additionally, average values were determined for mirrors after application of the model soils. The corrected average density readings for the 4 soiled mirrors ranged from −1.84 to −1.90. After, following the cleaning procedure with the sample specimen, 9 density readings are performed and an average Mirror Cleaning Densitometer Value is reported for each of the individual mirrors and across all 4 mirrors. The orientation of the mirrors and room lighting is such that streaks are not readily visible thus insuring a random location of each measurement taken within the limitations of the 3×3 grid described above. Furthermore, the density measurements correlate well with the visual grading system.

Figure 8:
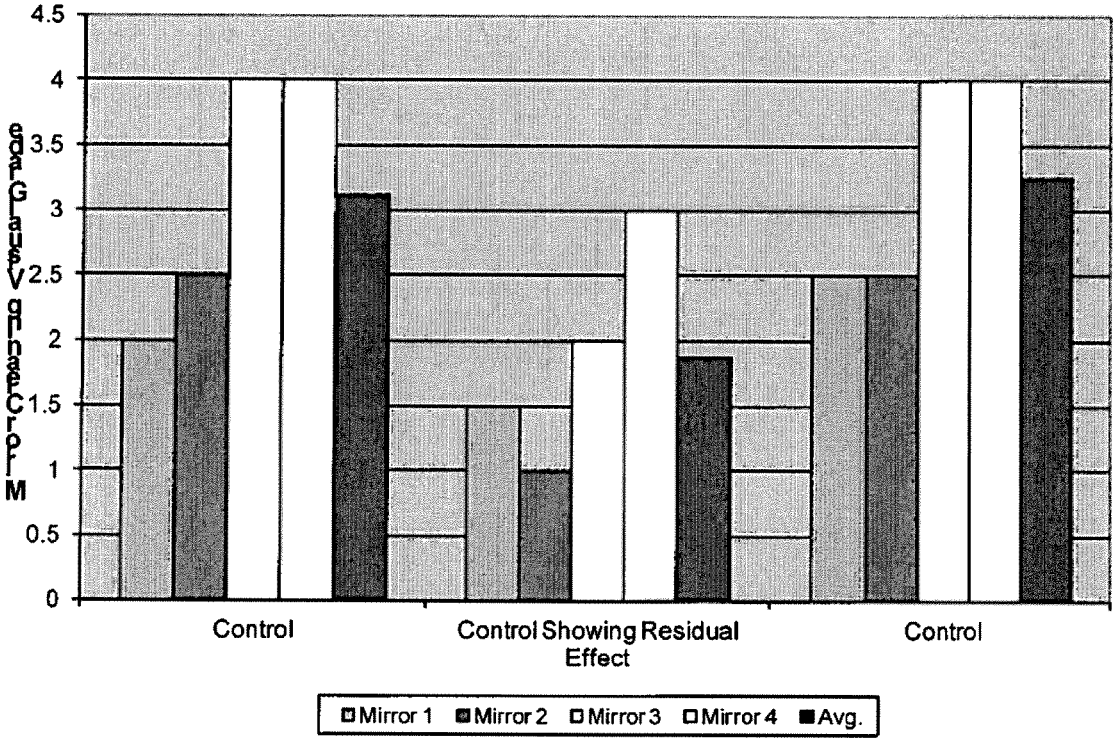
FIG. 8 is a bar graph showing the residual cleaning effect provided by an example of an article of manufacture of the present invention.

The above described Mirror Cleaning Test Method includes a cleaning process that insures there is no residual cleaning effect resulting from residual soil adsorbing agent that remains on a mirror surface (hard surface) after cleaning with an article of manufacture of the present invention, which comprises a soil adsorbing agent, according to the test. To measure any residual cleaning effect from an article of manufacture comprising a soil adsorbing agent, the above-described Mirror Cleaning Test Method is modified, where the normal process of bringing the mirrors back to their pristine condition is eliminated and replaced with a second cleaning step utilizing the Windex and an article of manufacture comprising a soil adsorbing agent. As a means of accelerating the potential buildup of soil adsorbing agent on the mirror, an article of manufacture is prepared with an exaggerated level of a soil adsorbing agent (12#/ton) applied to the external surfaces of an article of manufacture, such as a 2-ply fibrous structure for example a 2-ply paper towel. Initially, the mirrors are prepared utilizing the normal process described above of returning the mirrors to their pristine condition followed by application of the soil suspension. Each of the 4 mirrors are then cleaned with a control article of manufacture, such as a fibrous structure for example a paper towel (containing no soil adsorbing agent) and graded utilizing the visual grading technique and the densitometer. The mirrors are then cleaned twice as described above but with the article of manufacture comprising the 12#/ton soil adsorbing agent and the Windex. Visual inspection of the mirrors with aid of handheld light showed no streaks or smudges e.g. the mirrors are visually in pristine condition. Another round of soil suspension is then applied to the mirrors utilizing the normal technique and cleaned with the control product and visually graded. The mirrors were then returned to their pristine condition utilizing the normal cleaning procedure twice to insure complete removal of any residual soil attracting polymer. Another round of soil suspension is then applied and the mirrors are cleaned with the control and visually graded utilizing the handheld light. The data presented in FIG. 8 clearly shows the residual cleaning effect resulting from buildup of the soil adsorbing agent on the glass surface.

Charge Density Test Method

If one has identified or knows the soil adsorbing agent in and/or on an article of manufacture, then the charge density of the soil adsorbing agent can be determined by using a Mutek PCD-04 Particle Charge Detector available from BTG, or equivalent instrument. The following guidelines provided by BTG are used. Clearly, manufacturers of articles of manufacture comprising soil adsorbing agents know what soil adsorbing agent(s) are being included in their articles of manufacture. Therefore, such manufacturers and/or suppliers of the soil adsorbing agents used in the articles of manufacture can determine the charge density of the soil adsorbing agent.

1. Start with a 0.1% solution (0.1 g soil adsorbing agent+99.9 g deionized water). Depending on the titrant consumption increase or decrease soil adsorbing agent content. Solution pH is adjusted prior to final dilution as charge density of many additives is dependent upon solution pH. A pH of 4.5 is used here.

2. Place 20 mL of sample in the PCD measuring cell and insert piston.

3. Put the measuring cell with piston and sample in the PCD, the electrodes are facing the rear. Slide the cell along the guide until it touches the rear.

4. Pull piston upwards and turn it counter-clock-wise to lock the piston in place.

5. Switch on the motor. The streaming potential is shown on the touch panel. Wait 2 minutes until the signal is stable.

6. Use an oppositely charged titrant (for example for a cationic sample having a positive streaming potential: use an anionic titrant). Titrants are available from BTG consisting of 0.001N PVSK or 0.001N PolyDADMAC.

7. An automatic titrator available from BTG is utilized. After selecting the proper titrant, set the titrator to rinse the tubing by dispensing 10 mL insuring that all air bubbles have been purged.

8. Place tubing tip below the surface of the sample and start titration. The automatic titrator is set to stop automatically when the potential reaches 0 mV.

9. Record consumption of titrant, ideally, the consumption of titrant should be 0.2 mL to 10 mL; otherwise decrease or increase soil adsorbing agent content.

10. Repeat titration of a second 20 mL aliquot of the soil adsorbing agent sample.

11. Calculate charge demand (solution) or charge demand (solids);

$$\text{Charge demand } (eq/\text{L}) = \frac{V \text{ titrant used (L)} \times Conc. \text{ of titrant in Normality } (eq/\text{L})}{\text{Volume of sample titrated (L)}}$$

$$\text{Charge demand } (eq/\text{g}) = \frac{V \text{ titrant used (L)} \times Conc. \text{ of titrant in Normality } (eq/\text{L})}{\text{Wt. solids of the sample or its active substance (g)}}$$

The charge density (charge demand) of a soil adsorbing agent is reported in meq/g units.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or Claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended Claims all such changes and modifications that are within the scope of this invention.

What is claimed is:

1. A paper towel comprising an inverse emulsion comprising greater than 0.005% active solids basis of a soil adsorbing agent by weight of the paper towel, wherein the soil adsorbing agent exhibits a weight average molecular weight of greater than 750,000 to less than 40,000,000 g/mol and wherein the paper towel exhibits an average Soil Adsorption Value of about 90 mg soil/g article of manufacture or greater as measured according to the Soil Adsorption Test Method.

2. The paper towel according to claim 1 wherein the paper towel comprises a plurality of pulp fibers.

3. The paper towel according to claim 1 wherein the paper towel exhibits an average Mirror Cleaning Visual Grade Value of less than 2.5 as measured according to the Mirror Cleaning Test Method.

4. The paper towel according to claim 1 wherein the paper towel exhibits a total Mirror Cleaning Visual Grade Value of less than 10 as measured according to the Mirror Cleaning Test Method.

5. The paper towel according to claim 1 wherein the paper towel exhibits an average Mirror Cleaning Densitometer Value of −0.46 or greater as measured according to the Mirror Cleaning Test Method.

6. The paper towel according to claim 1 wherein the paper towel exhibits a total Mirror Cleaning Densitometer Value of −1.82 or greater as measured according to the Mirror Cleaning Test Method.

7. The paper towel according to claim 1 wherein the paper towel exhibits an average Soil Adsorption Value of about 95 mg soil/g article of manufacture or greater as measured according to the Soil Adsorption Test Method.

8. The paper towel according to claim 7 wherein the paper towel exhibits an average Soil Adsorption Value of greater than 100 mg soil/g article of manufacture as measured according to the Soil Adsorption Test Method.

9. The paper towel according to claim 1 wherein the soil adsorbing agent exhibits a charge density of less than 10 meq/g as measured according to the Charge Density Test Method.

10. The paper towel according to claim 1 wherein the soil adsorbing agent comprises a polymer.

11. The paper towel according to claim 10 wherein the polymer comprises a monomeric unit derived from a quaternary ammonium compound.

12. The paper towel according to claim 10 wherein the polymer comprises a monomeric unit derived from an amine compound.

13. The paper towel according to claim 10 wherein polymer comprises a monomeric unit derived from an acrylamide compound.

14. The paper towel according to claim 1 wherein the soil adsorbing agent comprises a flocculating agent.

15. The paper towel according to claim 1 wherein the soil adsorbing agent is present in the paper towel at a level of less than 5% active solids basis by weight of the paper towel.

16. The paper towel according to claim 1 wherein the paper towel comprises a surfactant.

17. The paper towel according to claim 16 wherein the surfactant is present in the paper towel at a level of from about 0.01% to about 0.5% by weight of the paper towel.

18. The paper towel according to claim 1 wherein the inverse emulsion is a dewatered inverse emulsion.

19. A paper towel comprising an inverse emulsion comprising greater than 0.005% active solids basis of a soil adsorbing agent by weight of the paper towel, wherein the soil adsorbing agent exhibits a weight average molecular weight of greater than 750,000 to less than 40,000,000 g/mol and wherein the paper towel exhibits an average Mirror Cleaning Visual Grade Value of less than 2.5 as measured according to the Mirror Cleaning Test Method.

20. The paper towel according to claim 19 wherein the paper towel comprises a plurality of pulp fibers.

21. The paper towel according to claim 19 wherein the paper towel exhibits a total Mirror Cleaning Visual Grade Value of less than 10 as measured according to the Mirror Cleaning Test Method.

22. The paper towel according to claim 19 wherein the paper towel exhibits an average Mirror Cleaning Densitometer Value of −0.46 or greater as measured according to the Mirror Cleaning Test Method.

23. The paper towel according to claim 19 wherein the paper towel exhibits a total Mirror Cleaning Densitometer Value of −1.82 or greater as measured according to the Mirror Cleaning Test Method.

24. The paper towel according to claim 19 wherein the soil adsorbing agent exhibits a charge density of less than 10 meq/g as measured according to the Charge Density Test Method.

25. The paper towel according to claim 19 wherein the soil adsorbing agent comprises a polymer.

26. The paper towel according to claim 25 wherein the polymer comprises a monomeric unit derived from a quaternary ammonium compound.

27. The paper towel according to claim 25 wherein the polymer comprises a monomeric unit derived from an amine compound.

28. The paper towel according to claim 25 wherein polymer comprises a monomeric unit derived from an acrylamide compound.

29. The paper towel according to claim 19 wherein the soil adsorbing agent comprises a flocculating agent.

30. The paper towel according to claim 19 wherein the soil adsorbing agent is present in the paper towel at a level of less than 5% active solids basis by weight of the paper towel.

31. The paper towel according to claim 19 wherein the paper towel comprises a surfactant.

32. The paper towel according to claim 31 wherein the surfactant is present in the paper towel at a level of from about 0.01% to about 0.5% by weight of the paper towel.

33. The paper towel according to claim 19 wherein the inverse emulsion is a dewatered inverse emulsion.

34. A paper towel comprising an inverse emulsion comprising a soil adsorbing agent comprising a polymer comprising at least 98% by weight of a monomeric unit derived from an acrylamide compound, wherein the paper towel exhibits an average Soil Adsorption Value of about 90 mg soil/g article of manufacture or greater as measured according to the Soil Adsorption Test Method.

35. The paper towel according to claim 34 wherein the paper towel comprises a plurality of pulp fibers.

36. The paper towel according to claim 34 wherein the paper towel exhibits a moisture level of less than 30%.

37. The paper towel according to claim 34 wherein the paper towel exhibits an average Mirror Cleaning Visual Grade Value of less than 2.5 as measured according to the Mirror Cleaning Test Method.

38. The paper towel according to claim 34 wherein the paper towel exhibits a total Mirror Cleaning Visual Grade Value of less than 10 as measured according to the Mirror Cleaning Test Method.

39. The paper towel according to claim 34 wherein the polymer exhibits a charge density of less than 10 meq/g as measured according to the Charge Density Test Method.

40. The paper towel according to claim 34 wherein the polymer further comprises a monomeric unit derived from a quaternary ammonium compound.

41. The paper towel according to claim 34 wherein the polymer further comprises a monomeric unit derived from an amine compound.

42. The paper towel according to claim 34 wherein the polymer comprises a monomeric unit derived from an acrylic acid compound.

43. The paper towel according to claim 34 wherein the soil adsorbing agent is present in the paper towel at a level of from greater than 0.005% to less than 5% active solids basis by weight of the paper towel.

44. The paper towel according to claim 34 wherein the inverse emulsion is a dewatered inverse emulsion.

* * * * *